US006964141B2

(12) United States Patent
Igarashi

(10) Patent No.: US 6,964,141 B2
(45) Date of Patent: Nov. 15, 2005

(54) BUILDING REINFORCING METHOD, MATERIAL, AND STRUCTURE

(75) Inventor: Shunichi Igarashi, Tokyo (JP)

(73) Assignee: Structural Quality Assurance Inc. (JP)

( * ) Notice: Subject to any disclaimer, the term of this patent is extended or adjusted under 35 U.S.C. 154(b) by 0 days.

(21) Appl. No.: 10/089,108

(22) PCT Filed: Dec. 26, 2000

(86) PCT No.: PCT/JP00/09265

§ 371 (c)(1),
(2), (4) Date: Mar. 26, 2002

(87) PCT Pub. No.: WO01/48337

PCT Pub. Date: Jul. 5, 2001

(65) Prior Publication Data

US 2003/0089063 A1 May 15, 2003

(30) Foreign Application Priority Data

| | | |
|---|---|---|
| Dec. 27, 1999 | (JP) | 11-370614 |
| Apr. 21, 2000 | (JP) | 2000-121405 |
| May 19, 2000 | (JP) | 2000-147916 |
| Oct. 24, 2000 | (JP) | 2000-324464 |

(51) Int. Cl.[7] ..... E04B 1/30; E04G 23/02

(52) U.S. Cl. ..... 52/746.1; 52/745.06; 52/745.09; 52/745.17; 52/723.1; 52/736.1; 52/514; 52/249; 52/105; 156/71; 156/94; 428/221; 428/292.1; 428/304.4

(58) Field of Search ..... 52/723.1, 746.1, 52/736.1, 105, 249, 514, 741.1, 741.3, 741.4, 741.41, 745.05, 723.2, 736.3, 745.06, 745.07, 745.08, 745.09, 745.1, 745.12, 745.17, 745.18, 745.19; 428/317.3, 221, 292.1, 304.4; 156/71, 94; 442/169, 175, 178

(56) References Cited

U.S. PATENT DOCUMENTS

| | | | | | |
|---|---|---|---|---|---|
| 2,721,823 | A | * | 10/1955 | Hopkins | 156/94 |
| 3,044,919 | A | * | 7/1962 | Stoneburner | 156/71 |
| 3,541,745 | A | * | 11/1970 | Probst | 52/105 |
| 3,581,884 | A | * | 6/1971 | Caldwell et al. | 428/41.3 |
| 3,763,609 | A | * | 10/1973 | Probst | 52/105 |
| 3,950,214 | A | * | 4/1976 | Pool et al. | 156/527 |
| 4,068,483 | A | * | 1/1978 | Papworth | 405/216 |
| 4,543,764 | A | * | 10/1985 | Kozikowski | 52/746.1 |
| 4,858,402 | A | * | 8/1989 | Putz | 52/105 |
| 4,892,601 | A | * | 1/1990 | Norwood | 156/94 |
| 4,908,085 | A | * | 3/1990 | Makus et al. | 156/215 |
| 5,043,033 | A | * | 8/1991 | Fyfe | 156/71 |
| 5,105,944 | A | * | 4/1992 | Ingalls et al. | 206/412 |
| 5,218,810 | A | * | 6/1993 | Isley, Jr. | 52/723.1 |
| 5,326,410 | A | * | 7/1994 | Boyles | 156/71 |
| 5,376,316 | A | * | 12/1994 | Weekers | 264/32 |
| 5,447,593 | A | * | 9/1995 | Tanaka et al. | 156/307.3 |

(Continued)

FOREIGN PATENT DOCUMENTS

| | | |
|---|---|---|
| JP | 9-72106 | 3/1997 |
| JP | 9-78848 | 3/1997 |
| JP | 9-78849 | 3/1997 |
| JP | 10-8423 | 1/1998 |
| JP | 10-205146 | 8/1998 |
| JP | 10-311146 | 11/1998 |
| JP | 11-36516 | 2/1999 |
| JP | 11-152907 | 6/1999 |

*Primary Examiner*—Jeanette E. Chapman
(74) *Attorney, Agent, or Firm*—Renner, Kenner, Greive, Bobak, Taylor & Weber

(57) ABSTRACT

A high-ductility material or a high-ductility covering material is disposed on the outer circumferential surface of a member, such as a column, of a structure so as to confine expansion of apparent volume accompanying rupture of the member, to thereby control rupture of the member. The high-ductility material is a fibrous or rubber sheet material. The high-ductility material is disposed in such a manner as to surround the member. Alternatively, the high-ductility material is spirally wound or rolled on the member.

9 Claims, 19 Drawing Sheets

U.S. PATENT DOCUMENTS 5,607,527 A * 3/1997 Isley, Jr. ..... 156/71
5,924,262 A * 7/1999 Fawley ..... 52/721.4
5,925,579 A * 7/1999 Neuner et al. ..... 442/175
6,219,991 B1 * 4/2001 Salek-Nejad ..... 52/741.3
6,363,681 B1 * 4/2002 Neuner ..... 52/723.1
6,519,909 B1 * 2/2003 Fawley ..... 52/721.4

* cited by examiner

BUILDING REINFORCING METHOD, MATERIAL, AND STRUCTURE

TECHNICAL FIELD

The present invention relates to a method, configuration, and material for reinforcing a structure for preventing serious damage to people and property in and around the structure, which would otherwise result from collapse of the structure, even after members (structural components, such as beams, girders, slabs, walls, and columns) of buildings and infrastructures (hereinafter generically called a "structure") are visibly deformed due to rupture thereof caused by an abruptly imposed external force, such as a seismic force or wind force or an excessive load accompanying demolition, or caused by deficiency in yield strength stemming from deterioration.

BACKGROUND ART

An external force imposed abruptly by earthquake or the like, or deficiency in yield strength stemming from deterioration has repeatedly caused an abrupt collapse of a structure, resulting in damage to lives and property.

A structure collapses in the following manner. Component members of a structure are ruptured due to excessive load or deficiency in yield strength. Resultant deterioration of stability of the overall fabric of the structure causes significant deformation to the shape of the structure, thereby causing a reduction in the internal space of the structure; i.e., structural collapse. In many cases of collapse of a building, floors fall down in a heap, like a stack of pancakes, or collapse. In many cases of collapse of an elevated bridge, bridge piers are ruptured, resulting in collapse of the bridge. Accordingly, it rupture can be controlled through reinforcement of various members of a structure, such as structural members, to thereby avoid deterioration of the overall structural stability even after the members are ruptured, possible damage to lives and property in and around a structure can be reduced.

Conventionally, in order to attain safety through avoidance of collapse of a structure, the following measures have been employed.

① The cross section or the like of a structural member is determined such that the structural member is not ruptured upon imposition of a required load, which is predetermined in consideration of the structural member's own weight and an external force to be abruptly imposed.

② When an assumed external force to be abruptly imposed after construction of a structure increases or when the yield strength of a structural member decreases due to deterioration or the like, the cross-sectional area or material strength of the structural member is increased. Alternatively, a high-strength member, such as an iron plate or carbon fiber, is disposed around a structural member to thereby enhance energy absorption capability (toughness) until the yield strength or rupture of the structural member is reached.

③ A seismic isolator is installed for a structure so as to decrease a seismic force to be imposed on the structure.

When a structure has been damaged by an external force imposed abruptly by earthquake or the like, the structure is tentatively evaluated for the degree of damage, and access to the structure may be forbidden, depending on the evaluated degree of damage. When an assumed seismic load is increased as a result of revision of design standard, an existing structure is subjected to antiseismic diagnosis, and antiseismic repairs or reinforcement is recommended in the case of a structure judged to run a high risk of seismic collapse.

However, the conventional measures ①–③ are based on a previously assumed level (a design value) of an external force to be imposed abruptly by earthquake or the like. When an external force in excess of the assumed level is imposed on a member, the member is ruptured, resulting in a failure to ensure the overall stability of a structure.

Naturally, expenses, time, and material required for carrying out the conventional measures described above do not reach a level involved in new construction of a structure, but do reach tens of percent of the level. Thus, in many cases, the conventional measures involve excessively high cost. Also, in many cases, the conventional measures require workers skilled in welding, installation of reinforcing bars, finishing, and the like. Hiring such skilled workers is difficult nowadays. Accordingly, even when an existing structure is known to involve a great risk of collapse due to deterioration, or because the structure is designed according to old standard or has been damaged by an external force imposed abruptly by earthquake or the like, in many cases, reinforcement of the structure has been unfeasible, for economic and physical reasons. In a certain case, after occurrence of disaster, such as earthquake, when an examiner(s) entered a damaged structure in order to tentatively evaluate the degree of collapse risk, an aftershock caused the structure to collapse, with the result that the examiner(s) were killed or injured. In another case, when dwellers and users entered a structure which was judged safe in view of minor damage, an aftershock caused the structure to collapse, resulting in heavy casualties.

FIG. 21 shows typical loads imposed on a column 1, which is a typical structural member, and a corresponding displacement. A load is imposed on an end portion of a member or is imposed on a member in a concentrated or distributed condition. A load assumes the form of a force or moment. FIG. 21 shows typical loads to be imposed. FIG. 22 shows the relationship between a load to be imposed on a member and a corresponding displacement as shown in FIG. 21, in relation to the conventional measures described above. As shown in FIG. 22, reinforcement enhances strength and/or toughness; however, there is no guarantee that the member can bear an upper load after a toughness limit is exceeded.

Specifically, in the case of a small range of deformation (within 2%–3%), the conventional measures described above enable a member to bear a load, to thereby ensure the overall stability of a structure. However, in the case of deformation in excess of the range, a mechanism for bearing a load is lost, resulting in rapid progress of deformation. As a result, collapse of the structure becomes unavoidable. For example, in an example of a column 1 shown in FIG. 24(*a*), tie hoops arranged within the reinforced concrete column 1 can bear a circumferential tensile force T and a shearing stress S induced by an axial force (a vertical force) P that falls within a tolerance and thus induces merely a small range of deformation (within several %). However, the shearing stress S causes a shear fracture of the column 1 with a resultant impairment in rigidity, or an excessive axial force causes rupture or dislocation of a tie hoop(s) with a resultant failure to bear the circumferential tensile force T. As a result, as shown in FIG. 24(*b*), deformation progresses rapidly, followed by complete collapse as shown in FIG. 24(*c*). In this manner, the aforementioned pancake-like destruction phenomenon unavoidably occurs. Also, when a member 15 assumes the form of a beam 16 as shown in FIG. 25, cracks 20 and the yield of a reinforcing bar(s) cause compression rupture of a portion enclosed by the dashed line in FIG. 25.

In the case where a large number of structures must be reinforced immediately after occurrence of an abrupt disaster, such as earthquake, or due to revision of the seismic standard, the conventional measures described above are unsuitable for promptly coping with the situation so as to secure safety.

In view of the above problems involved in the conventional measures, an object of the present invention is to provide a method and configuration of reinforcement which are applied, from the beginning, to various members including structural members of a newly constructed structure or are applied to various members including structural members of an existing structure so as to control rupture for delaying progress thereof and delaying expansion of a spatial rupture region, thereby avoiding complete loss of the load sharing capability of the members, which would otherwise result from local rupture of the members; i.e., thereby enabling the members to share a load with one another to such an extent as to avoid collapse of the structure even after the members are visibly deformed. Another object of the present invention is to practice economy in expenses, time, and material required for reinforcement work as compared with the conventional measures, thereby enabling prompt reinforcement of a large number of structures.

DISCLOSURE OF THE INVENTION

To achieve the above objects, the present invention is configurationally characterized by utilizing the phenomenon that materials, such as concrete, wood, soil, and brick, which partially constitute various members, including structural members, expand in apparent volume upon rupture. Specifically, expansion of apparent volume is elastically confined by means of high-ductility materials (high-ductility covering materials) disposed around corresponding members including structural members, thereby delaying the progress of rupture and, after termination of imposition of an abrupt external force, thereby enabling the members to share with one another the weight of a structure and to substantially maintain their shapes. An apparent volume appearing herein refers to a volume enclosed by a surface (an enveloping surface) that smoothly envelopes the end and side faces of a member. Expansion of apparent volume resulting from rupture refers to the following phenomenon. As shown in FIG. 23(*a*), before rupture, a member 15 includes two end faces 2 and a side face 3. As shown in FIG. 23(*b*), the member 15 is ruptured along a rupture plane 4 into two rupture pieces 9. As a result of slide between the rupture pieces 9, an enveloping surface 10 is expanded; i.e., the apparent volume is expanded. As shown in FIG. 23(*b*), a cavity t is present between the enveloping surface 10 and the ruptured member 15. The present invention is configurationally characterized in that the member 15 is covered by a high-ductility material (a high-ductility covering material) such that a weak layer (including the cavity t) is provided between the member 15 and the high-ductility material, thereby enabling the high-ductility material (the high-ductility covering material) to be deformed along the enveloping surface even after rupture of the member 15.

A first invention (method) is configurationally characterized by disposing a high-ductility material on the outer circumferential surface of a member of a structure so as to confine expansion of apparent volume accompanying rupture of the member, to thereby control rupture of the member.

A second invention (structure) is configurationally characterized by disposing a high-ductility material on the outer circumferential surface of a member of a structure so as to elastically confine expansion of apparent volume accompanying rupture of the member, to thereby control rupture of the member.

In the first and second inventions, the high-ductility material is preferably a fibrous or rubber sheet material (including a tape-like sheet material). In this case, the high-ductility material may be rolled on a core to thereby form a cored roll of high-ductility material (a third invention). In the third invention, a plurality of parting lines, which can be visually or tactilely discriminated from one another, are drawn on one side of the high-ductility material along the length direction of the high-ductility material. The parting lines enable equally dividing the width of the high-ductility material at any one of two or more different pitches, thereby facilitating discrimination in division on a work site and thus contributing to enhancement of work efficiency. In the first or second invention, in consideration of installation conditions and work restrictions in relation to a member to be covered, the high-ductility material can be disposed in such a manner as to surround the member or to be spirally wound or rolled on the member. Alternatively, the high-ductility material can be disposed through application of a rubber or resin viscous-material to the member by appropriate application means, such as spraying. In the first or second invention, the high-ductility material (high-ductility covering material) can be disposed such that a cavity or a weak layer is interposed between the high-ductility material (high-ductility covering material) and the member, thereby avoiding direct rupture of the high-ductility material (high-ductility covering material) by the member and thus enabling the high-ductility material (high-ductility covering material) to yield an elastic confining effect more reliably. As a result of interposition of the cavity or weak layer, the high-ductility material (high-ductility covering material) can elastically confine expansion of apparent volume of the member in a far more reliable manner while maintaining an enveloping surface against diversified rupture form of the member (in FIG. 23(*b*), the cavity t is present between the member 15 and the enveloping surface 10).

A fourth invention (method) is configurationally characterized by fixedly attaching a high-ductility covering material formed of a raw material having an elastic modulus lower than that of a tie hoop to the outer circumferential surface of an existing column supporting a structure, to thereby cause the high-ductility covering material to bear a load imposed on the column after the column is deformed. In this case, the high-ductility covering material can comprise a plurality of surrounding cores disposed around the column in such a manner as to be arranged at predetermined intervals along a vertical direction, and a fibrous or rubber sheet material connecting the adjacent surrounding cores along the vertical direction, to thereby assume the form of an integral bellows-like reinforcement.

A fifth invention (method) is configurationally characterized in that a high-ductility covering material formed of a raw material having an elastic modulus lower than that of a tie hoop is disposed inside a facing surrounding wall material disposed around an existing column supporting a structure with a cavity interposed between the facing surrounding wall material and the column, to thereby cause the high-ductility covering material to bear a load imposed on the column after the column is deformed. In this case, the high-ductility covering material can comprise a plurality of surrounding cores disposed around the column with the cavity interposed therebetween in such a manner as to be arranged at predetermined intervals along a vertical direction, and a fibrous or rubber sheet material connecting the adjacent surrounding cores along the vertical direction, to thereby assume the form of an integral bellows-like reinforcement.

A sixth invention (structure) is configurationally characterized by fixedly attaching a high-ductility covering material formed of a raw material having an elastic modulus lower than that of a tie hoop to the outer circumferential surface of a column supporting a structure. In this case, preferably, the high-ductility covering material comprises a plurality of surrounding cores disposed around the column in such a manner as to be arranged at predetermined intervals along a vertical direction, and a fibrous or rubber sheet material connecting the adjacent surrounding cores along the vertical direction, to thereby assume the form of an integral bellows-like reinforcement.

A seventh invention (structure) is configurationally characterized in that a high-ductility covering material formed of a raw material having an elastic modulus lower than that of a tie hoop is disposed inside a facing surrounding frame disposed around a column supporting a structure with a cavity interposed between the facing surrounding frame and the column. In this case, preferably, the high-ductility covering material comprises a plurality of surrounding cores disposed around the column with the cavity interposed therebetween in such a manner as to be arranged at predetermined intervals along a vertical direction, and a fibrous or rubber sheet material connecting the adjacent surrounding cores along the vertical direction, to thereby assume the form of an integral bellows-like reinforcement.

BEST MODE FOR CARRYING OUT THE INVENTION

Figure 1:
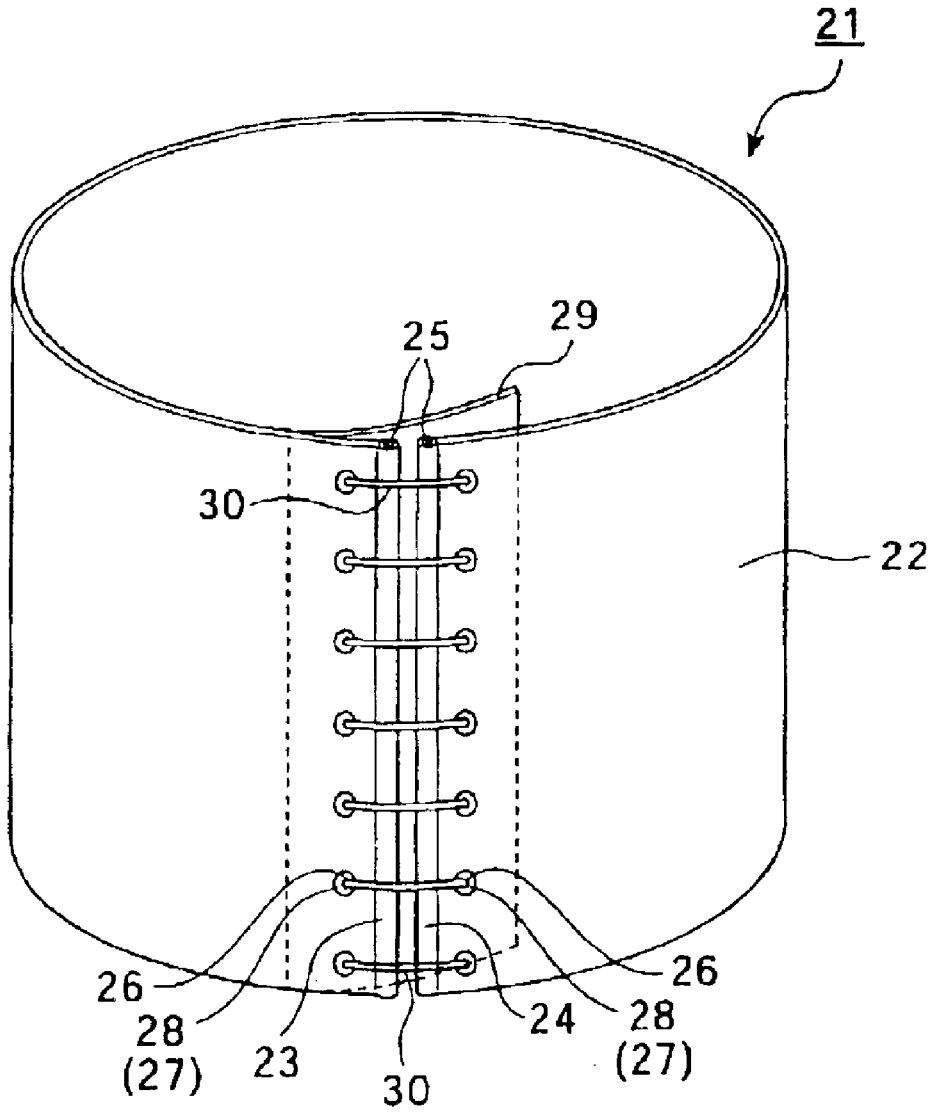
FIG. 1 is a general perspective view showing a structural example of a high-ductility material to be used when the present invention is to be applied to a new or existing member (structural member), which is formed predominantly of concrete, of a structure.

FIG. 1 is a general perspective view showing a structural example of a high-ductility material to be used in the present invention with various members, such as structural members, of a structure in order to control rupture of a member through confining volume expansion of the member accompanying rupture of the member.

As shown in FIG. 1, a high-ductility material 21 includes a sheet portion 22 having an appropriate longitudinal length and an appropriate width and serving as a main boy, one end portion 23, and the other end portion 24, the end portions 23 and 24 butting each other in the circumferential direction.

Core cords 25 are disposed respectively at one end portion 23 and the other end portion 24 of the sheet portion 22 in such a manner as to thread through the end portions 23 and 24 along the longitudinal-length direction. The core cord 25 reinforce one end portion 23 and the other end portion 24 to thereby enhance durability in the tensile direction.

Through-holes 26 for allowing a tie cord 30 to pass through are provided in the vicinity of one end portion 23 and the other end portion 24 while been arranged at predetermined intervals along the length direction of the end portions. Appropriate reinforcement members 27, such as eyelets 28, are provided at the corresponding through-holes 26. The reinforcement members 27 reinforce the circumferential edge portions of the corresponding through-holes 26, whereby the tie cord 30 can be reliably held in a tight condition.

Furthermore, a tonguelike patch 29 having a longitudinal length substantially equal to the width of the sheet portion 22 is sewn on the back side of at least either one end portion 23 or the other end portion 24 of the sheet portion 22 (on the back side of one end portion 23 in the illustrated example) along the length direction of one end portion 23, so that the interface between one end portion 23 and the other end portion 24 can be covered with the patch 29. Notably, one end portion 23 and the other end portion 24 may be each provided with the patch 29, which is not shown, so that the interface between one end portion 23 and the other end portion 24 can be covered with the two layered patches 29.

The sheet portion 22 and the patch 29, which partially constitute the high-ductility material 21, are made of a circumferentially and vertically homogeneous material. Particularly, a fiber material or a rubber material whose ductility is high and whose initial elastic modulus is lower than that of iron and concrete is preferably used. Specifically, a sheet material made of a synthetic fiber material (e.g., TORAYSHEET, the trade name of a product of Toray Industries, Inc.) or a rubber material (e.g., GEOLINER, the trade name of a product of Bridgestone Corp.) having high ductility and strength capable of bearing a load is preferably used.

Figure 12A:
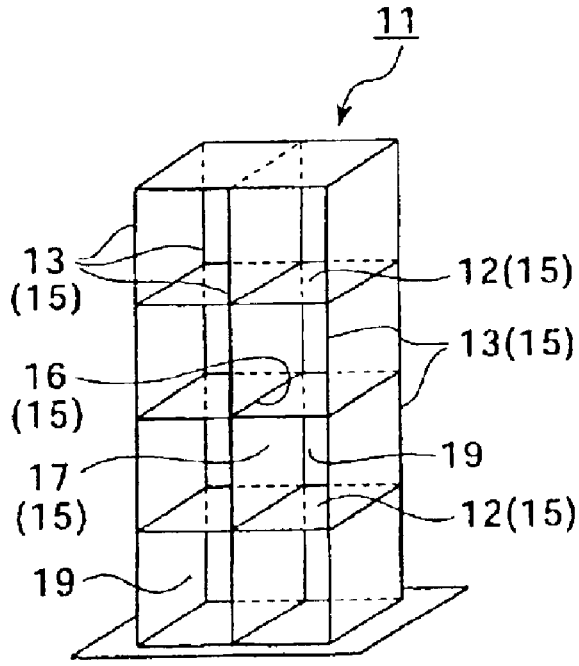
FIG. 12 is a series of explanatory views showing a state of a structure (building) to which the present invention is applied, wherein (a) shows a state before collapse; and (b) shows a state after collapse.
Figure 12B:
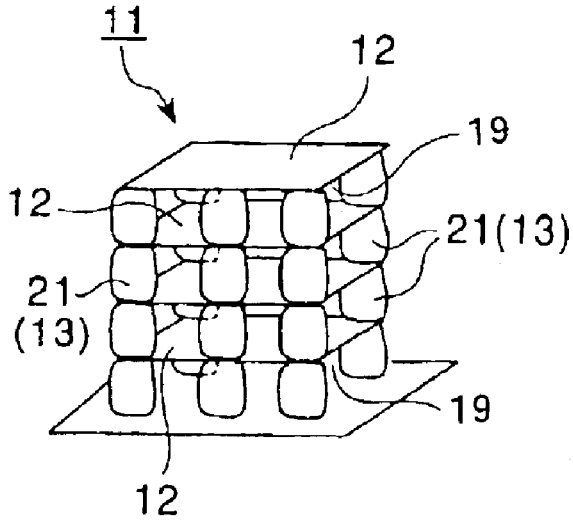
Figure 13A:
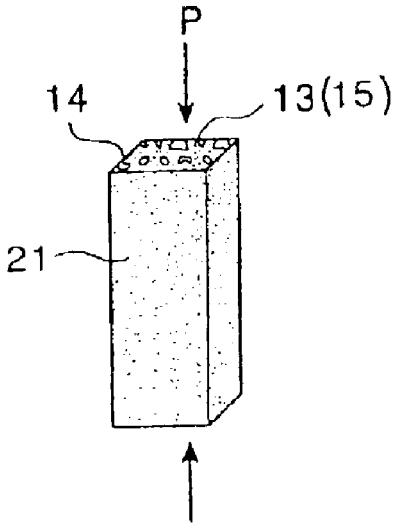
FIG. 13 is a series of explanatory views showing a state of a member (a structural member) to which the present invention is applied, wherein (a) shows a state before collapse; and (b) shows a state after collapse.
Figure 13B:
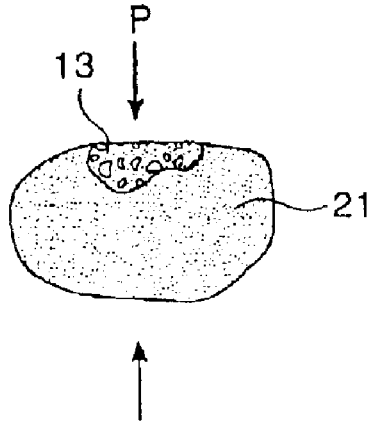

Thus, the high-ductility material 21 can be wound on, for example, an outer circumferential surface 14 of a column 13 serving as a structural member 15 as shown in FIG. 13(*a*), which column 13 stands to support, for example, a floor 12 of a structure (building) 11 schematically shown in FIG. 12(*a*), while the patch 29 is positioned between the column 13 and the sheet portion 22, and one end portion 23 and the other end portion 24 butt each other.

The high-ductility material 21 wound on the column 13 serving as the structural member 15 can be readily maintained in a fixed and surrounding condition by cross-linking the through-holes 26 formed in one end portion 23 and the through-holes 26 formed in the other end portion 24 by means of the tie cord 30 so as to unite the end portions 23 and 24, while the end portions 23 and 24 are lined with the patch 29. In this manner, through simple installation performed within a short period of time, the high-ductility material 21 can maintain such a state as to surround the column 13 completely.

FIG. 1 shows an application example of the present invention to be applied to the member including the column formed predominantly of concrete, wood, soil, brick or the like. However, in the case where the structure 11 is under construction, the high-ductility material 21 can be used similarly; specifically, the high-ductility material 21 can be wound on, for example, a beam (girder) 16 shown in FIG. 12(*a*) or a wall 17 shown in FIG. 2(*a*), to thereby surround the member.

The above-described connection structure is not limited to the illustrated example. A known uniting structure, such as sewing or bonding, can be used as appropriate so long as one end portion 23 and the other end portion 24 can be united in such a manner as not to be separated from each other upon reception of load.

Figure 2A:
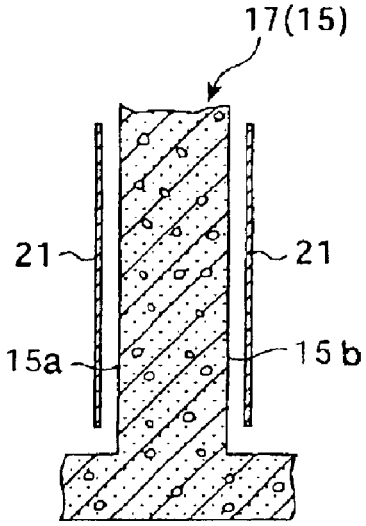
FIG. 2 is a series of cross-sectional views of a main portion of a member of a structure showing an application example of the present invention in which the member is an existing wall formed predominantly of concrete and serving as a structural member, wherein (a) shows a state in which high-ductility materials are disposed such that a wall is sandwiched therebetween; (b) shows a state in which through-holes are formed in the wall for passing a connection cord therethrough in order to connect the high-ductility materials; and (c) shows a state in which the high-ductility materials are connected by means of the connection cord passing through the through-holes.
Figure 2B:
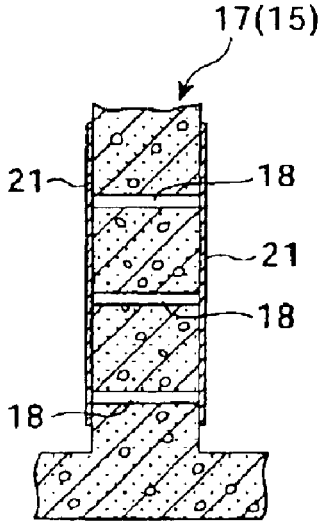
Figure 2C:
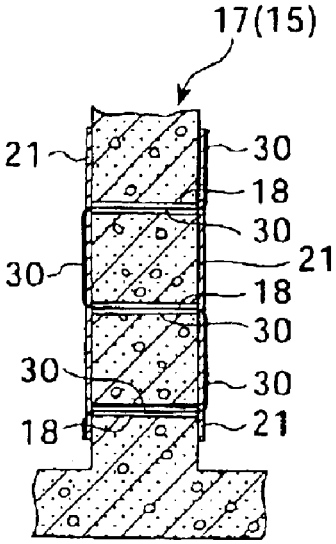

FIGS. 2(*a*) to 2(*c*) are cross-sectional view of a main portion of the member 15 of the structure 11 showing an application example of the present invention in which the member 15 is an existing wall 17 formed predominantly of concrete and serving as a structural member.

As shown in FIG. 2(*a*), the high-ductility materials 21 are respectively disposed on one side surface 15*a* and the other side surface 15*b* of the wall 17, which serves as a partition installed across a space 19 of the structure (building) 11 shown in FIG. 12(*a*) (in the case of a wall 17 under construction, the high-ductility material 21 can be disposed in such a manner as to surround the wall 17 as shown in FIG. 1).

As shown in FIG. 2(*b*), through-holes 18 are formed in the wall 17 in such a manner as to extend horizontally between one side surface 15*a* and the other side surface 15*b* and to be arranged at predetermined intervals. Each of the through-holes 18 has a diameter capable of allowing the passage of the tie cord 30 for connecting the high-ductility materials 21. It is not specifically shown in the illustrated example, but the through-holes 18 are arranged not only horizontally but also vertically at predetermined intervals in a substantially parallel condition. Preferably, a circumferential edge portion of each through-hole 18 is reinforced by means of a reinforcement member, such as the eyelet 28 shown in FIG. 1.

As shown in FIG. 2(*c*), the tie cord 30 is passed through the through-holes 18 and fixed to the high-ductility materials 21 to thereby reliably connect the high-ductility materials 21. Notably, a plurality of tie cords 30 may be passed through the corresponding through-holes 18 to thereby individually connect the high-ductility materials 21. Alternatively, as in the case of the illustrated example, a single tie cord 30 is sequentially passed through the through-holes 18 to thereby connect the high-ductility materials 21 in a sewing condition.

FIG. 2 shows an example in which the member 15 is the wall 17 formed predominantly of concrete, wood, soil, brick or the like and serving as a structural member. However, in the case of an existing structure 11, the high-ductility materials 21 can also be applied to the beam (girder) 16 shown in FIG. 12(*a*) and can be reliably connected in a similar manner.

Figure 3A:
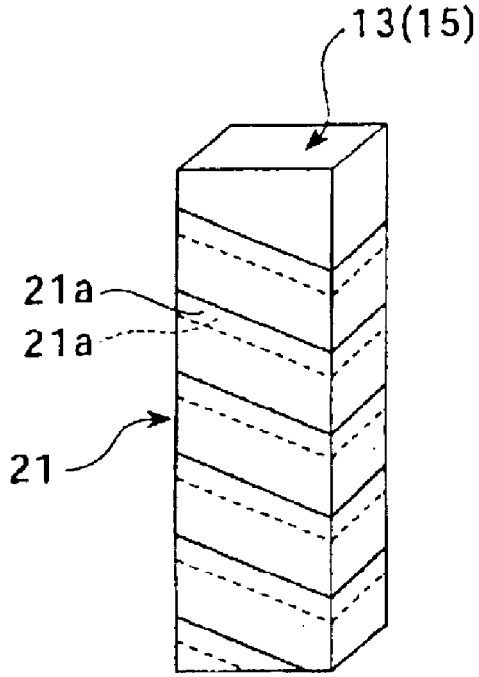
FIG. 3 is a series of views showing another application example of the present invention in which a member of a structure is an existing column formed predominantly of concrete, wherein (a) shows a state in which a tape-like high-ductility material is spirally wound on the outer circumferential surface of the column; and (b) shows the figure of the high-ductility material in storage.
Figure 3B:
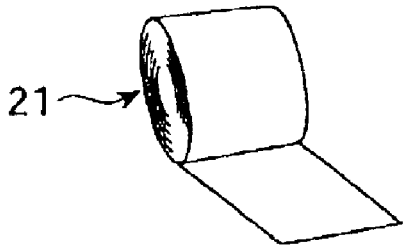

FIG. 3(*a*) shows an example in which an elastic tape-like high-ductility material 21 is spirally wound on the member (the column 13 in the illustrated example) 15 of a structure while overlapping at overlap portions 21*a*, as in the case of winding tape on the grip of a tennis racket. In this case, preferably, in order to prevent dislocation of the wound high-ductility material 21, the following installation methods are employed.

① Winding is performed while an appropriate tension is applied.

② The elastic high-ductility material 21 and the member 15 are bonded by use of an adhesive, or the overlap portions 21*a* of the spirally wound high-ductility material 21 are bonded by use of an adhesive or welded together.

③ The high-ductility material 21 is fixedly attached to the member 15 by use of a fixing member, such as a nail.

The high-ductility material 21 is fixed at an end portion of the member 15 by the method ② or ③ mentioned above. According to an alternative method, as in the case of fixing an end portion of an elastic bandage of medical use, eyelets as shown in FIG. 1 are formed on the high-ductility material 21, and a cord is passed through the eyelets so as to fix the high-ductility material 21 at an end portion of the member 15.

Through employment of the method shown in FIG. 3(*a*), the high-ductility material 21 can be spirally wound on the outer surface of a partially damaged member 15 formed predominantly of concrete, wood, soil, brick or the like. The high-ductility material 21 is prepared in a rolled state as shown in FIG. 3(*b*) so as to be promptly usable upon occurrence of disaster, such as earthquake. It is desirable that emergency measures to cope with disaster be able to be carried out readily and manually without reliance on a mechanical force. In this point of view, employment of the method shown in FIG. 3 is advantageous. For example, when a roll of the high-ductility material 21 formed of TORAYSHEET 800 T (thickness 1.26 mm; weight 930 g/m$^2$) is to be used, employment of a width of approx. 50 cm and a length of approx. 20 m will make an overall weight of approx. 10 kg, so that the roll can be carried manually for application to the emergency measures mentioned above.

Figure 4:
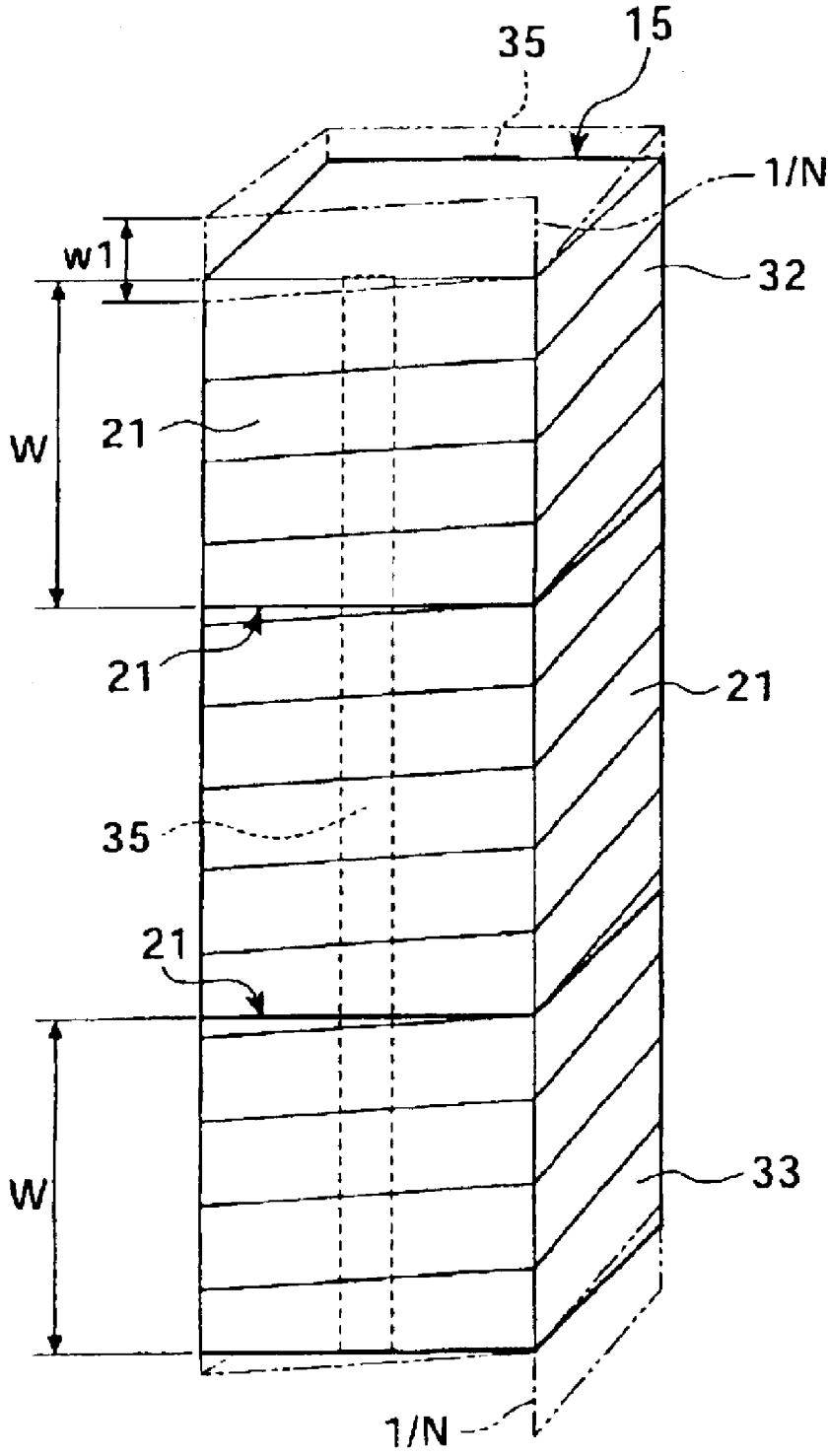
FIG. 4 is a general perspective view showing another example of a state in which a high-ductility material is spirally wound.
Figure 5:
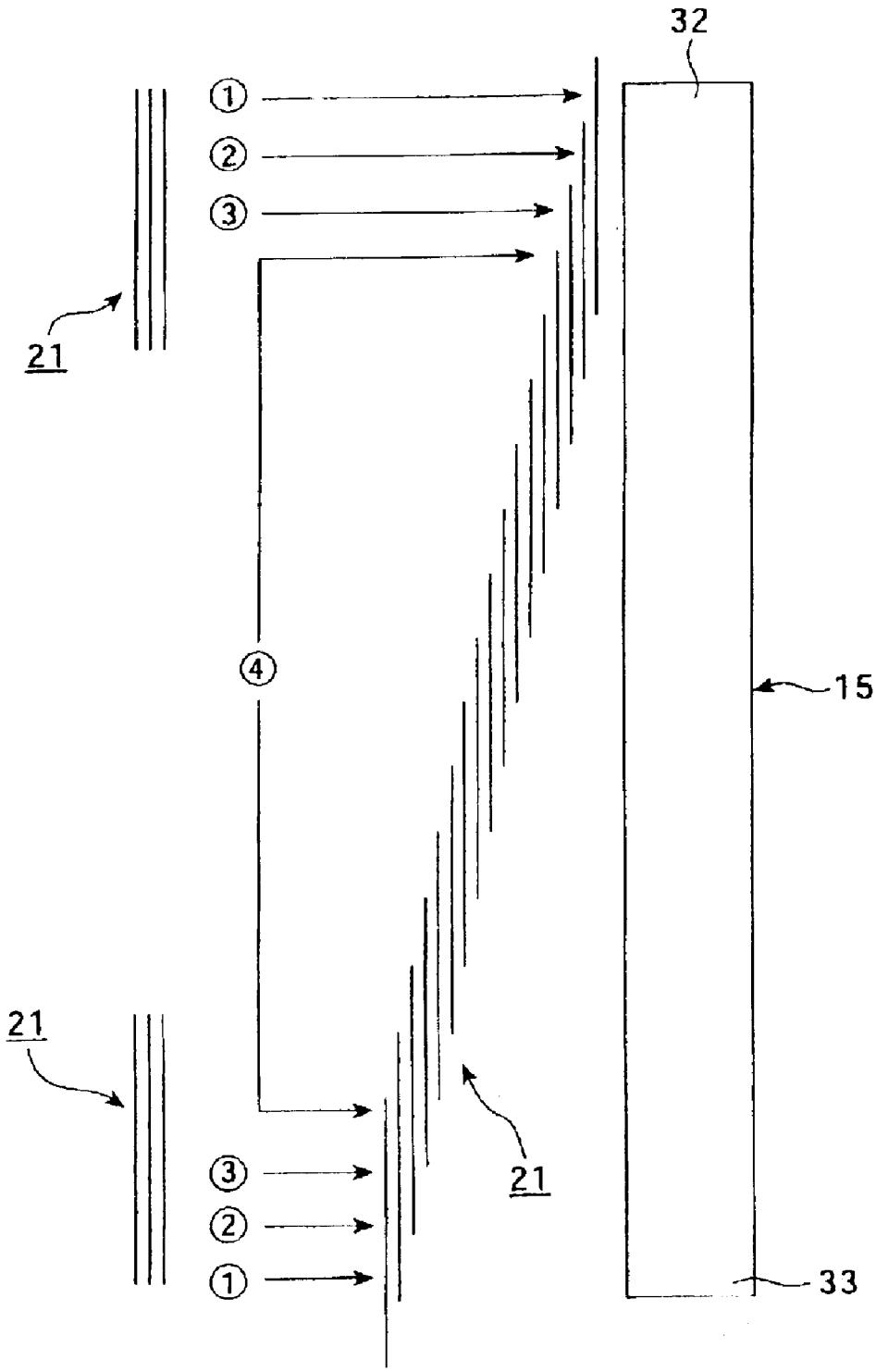
FIG. 5 is an explanatory view schematically showing a state of winding of the high-ductility material in the example of FIG. 4.

FIG. 4 is an explanatory view showing another example of a pattern for spiral winding shown in FIG. 3. In this case, as shown in FIG. 5, the high-ductility material 21 is first wound on an upper end portion 32 of the member 15 by a single turn (① in FIG. 5) and is then wound while the number of overlap turns is sequentially increased until a predetermined maximum number of overlap turns is reached; specifically, the high-ductility material 21 is wound sequentially by two overlap turns (② in FIG. 5), three overlap turns (③ in FIG. 5), and four overlap turns (④ in FIG. 5), which is the predetermined maximum number of overlap turns. Then, the high-ductility material 21 is spirally wound while the maximum number of overlap turns is maintained along a predetermined length of the member 15. Subsequently, the high-ductility material 21 is spirally wound while the number of overlap turns is sequentially decreased; specifically, the high-ductility material 21 is wound sequentially by three overlap turns (③ in FIG. 5), two overlap turns (② in FIG. 5), and by a single turn (① in FIG. 5) at a lower end portion 33 of the member 15. In FIG. 5, in order to clarify a state of winding, the high-ductility material 21 is disposed away from the member 15. In actuality, the high-ductility material 21 is closely wound on the member 15. Furthermore, on end portions (the upper end portion 32 and the lower end portion 33) of the member 15, the high-ductility material 21 is rolled by the number of turns which is smaller by one than the maximum number of overlap turns N for spiral winding. In the example of FIG. 5, the high-ductility material 21 is rolled by three turns as obtained through subtraction of 1 from 4, which is the maximum number of overlap turns for spiral winding. Accordingly, the end portions (the upper end portion 32 and the lower end portion 33) are wound with the high-ductility material 21 by the maximum number of overlap turns N to (2N−1) overlap turns. Since stress concentrates at the end portions (the upper end portion 32 and the lower end portion 33) of the member 15, such winding can impart safety allowance to the member 15. The respective turns of the spirally wound high-ductility material 21 are bonded to each other by means of an adhesive, such as LUBIRON (the trade name of a product of Toyo Polymer Co., Ltd.), applied to one side surface and the opposite side surface of the member 15 in such a manner as to extend in the length direction of the member 15 while having an appropriate width capable of yielding a tension (strength) T not less than a required level. Thus, the high-ductility material 21 is bonded to the member 15.

Figure 6:
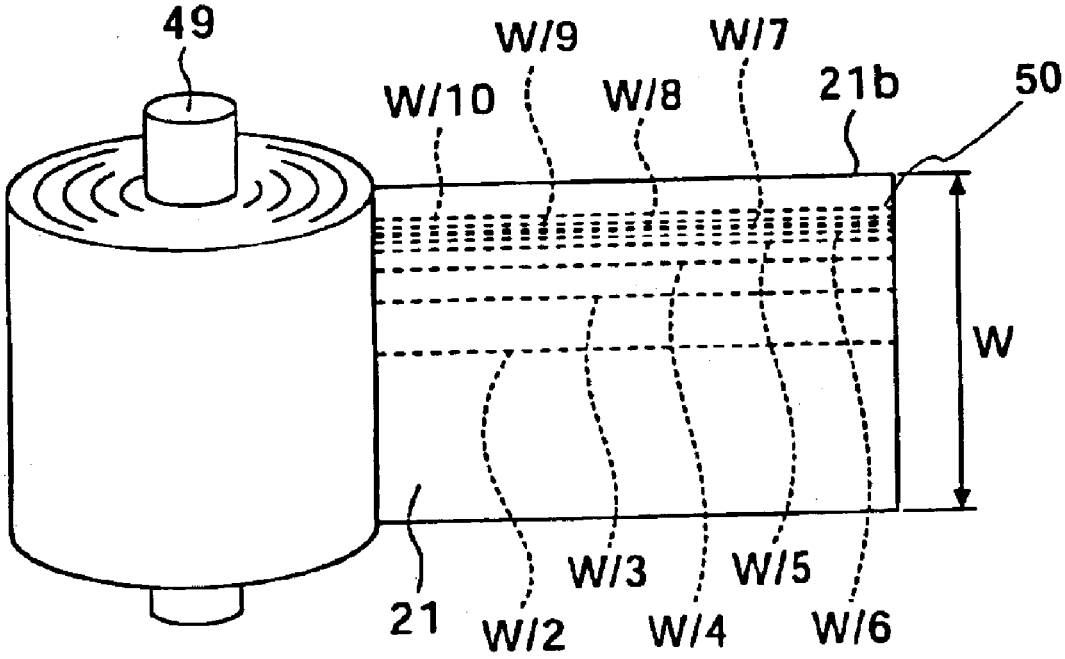
FIG. 6 is an explanatory view showing an example of a cored roll of high-ductility material according to the present invention.

FIG. 6 exemplifies the high-ductility material 21 which is rolled on a core 49 made of an appropriate material, such as wood or resin, so as to be useful in the case where a spiral winding pattern shown in FIG. 4 is such that the maximum number of overlap turns (the maximum number of layers) is N as shown in FIG. 5. In this case, a plurality of parting lines 50 for equally dividing the width W of the high-ductility material 21 are drawn on the high-ductility material 21 in a region extending between the centerline and a side edge 21*b* along the length direction of the high-ductility material 21 so as to be indicative of, for example, divisions ½ (maximum width), ⅓, ¼, . . . , 1/N, . . . , 1/10 (a minimum width when the width W is equally divided so as to obtain a predetermined maximum number of overlap turns). For example, when the maximum number of overlap turns is N, at the first turn, the high-ductility material 21 is shifted by 1/N ($w_1$ in FIG. 4). Subsequently, the high-ductility material 21 is wound along the 1/N line in an overlapping condition, whereby the winding pattern as shown in FIG. 4 is attained. Preferably, for easy discrimination among the parting lines 50, the parting lines 50 are drawn in different colors or line types, caused to bulge (protrude) for tactile discrimination, or drawn with fluorescent paint.

A roll of high-ductility material 21 shown in FIG. 6 is spirally wound on the member 15 from the upper end portion 32 (or from the lower end portion 33) along the length direction of the member 15 while being shifted by one-fourth of the width W ($w_1$) per turn. Winding is terminated such that one-fourth or less of the width W ($w_1$) is left unused while the high-ductility material 21 is wound by a single turn to four turns.

FIGS. 4 and 5 show an example in which the high-ductility material 21 is wound by up to four overlap turns. When the letter N represents the maximum number of overlap turns (the maximum number of layers), the high-ductility material 21 shown in FIG. 4 is spirally wound while being shifted by 1/N per turn. Notably, the optimum number of overlap turns N is determined on the basis of a required strength T and an allowable strain $X_0$ appearing in calculational expressions to be described later.

Figure 7A:
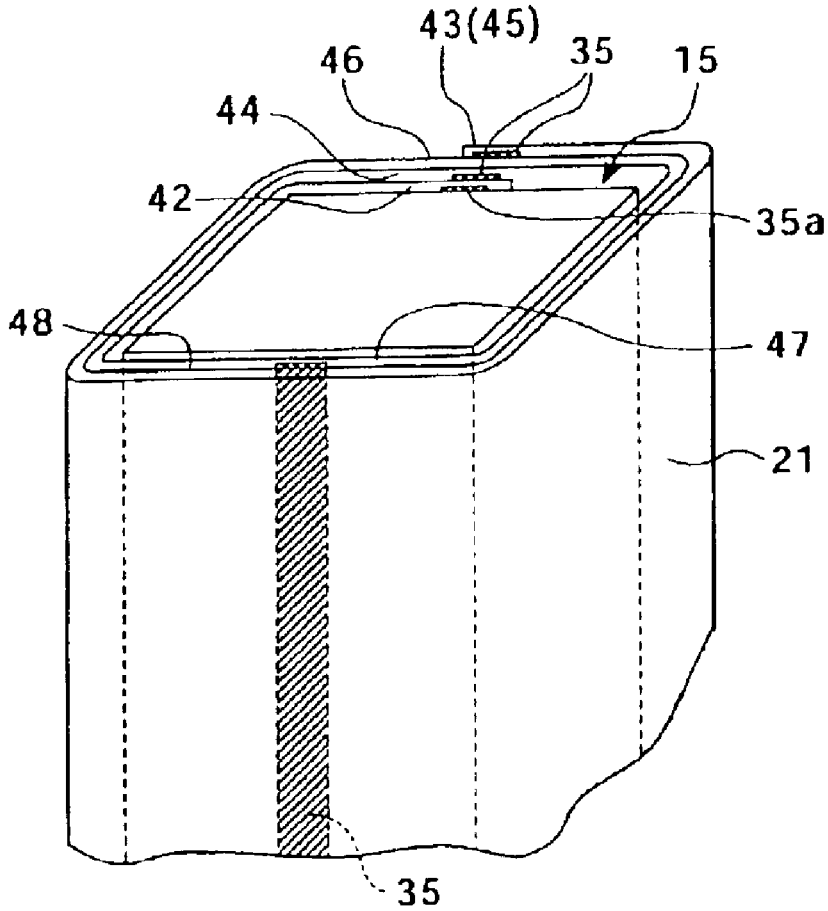
FIGS. 7(*a*) and 7(*b*) are explanatory views showing a state in which a high-ductility material is rolled by three turns on a member, wherein FIG. 7(*a*) is a perspective view of a main portion of the reinforcement, and FIG. 7(*b*) is a crass-sectional view of FIG. 7(*a*)
Figure 7B:
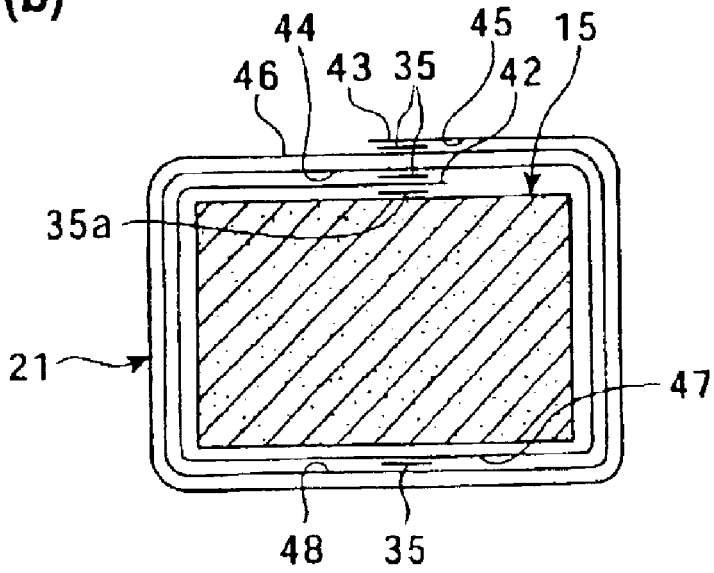

FIGS. 7(*a*) and 7(*b*) are explanatory views showing a state in which the high-ductility material 21 is rolled by three turns on the member 15, such as an existing column 13 or a new column 13, wherein FIG. 7(*a*) is a perspective view of a main portion of the reinforcement, and FIG. 7(*b*) is a cross-sectional view of FIG. 7(*a*).

In FIGS. 7(*a*) and 7(*b*), the high-ductility material 21 is formed of a fibrous or rubber tape-like sheet material. At least a circumferentially rolling start end portion 42 of the high-ductility material 21 is bonded to the outer surface of the member 15 by means of an adhesive 35*a*. The rolling start end portion 42 and a corresponding portion 44 of the overlying high-ductility material 21 are bonded together by means of the adhesive 35. At a rolling termination end portion 43 of the high-ductility material 21, overlap portions 45 and 46 are bonded together by means of the adhesive 35. Thus, the high-ductility material 21 is closely rolled on the member 15 in three layers. Notably, the adhesive 35*a* used at the rolling start end portion 42 is adapted to tentatively bond the rolling start end portion 42 to the member 15 and, thus, is not necessarily the same as the adhesive 35 used for bonding layers of the high-ductility material 21. When the adhesive 35 is used as the adhesive 35*a*, an appropriate measure to avoid excessively strong bond between the member 15 and the high-ductility material 21 must be employed; for example, the bonding area must be narrowed.

In this case, the high-ductility material 21 is rolled on the outer circumferential surface of the member 15 such that intermediate layers of the high-ductility material 21 is bonded at a position located opposite the rolling start end portion 42 and the rolling termination end portion 43 with respect to the member 15; specifically, overlap portions 47 and 48 of the first and second layers of the high-ductility material 21 are bonded together by means of the adhesive 35 at a single zonal region extending along the length direction of the member 15.

FIGS. 7(*a*) and 7(*b*) show an example in which the high-ductility material 21 is rolled by three turns. However, the number of turns required for obtainment of a required strength is not limited thereto. The optimum number of turns N is determined on the basis of a required strength T and an allowable strain $X_0$ appearing in calculational expressions to be described later.

Specifically, the number of turns $N_1$ required for obtainment of a required strength is represented by the following expression, where $T_1$ is the strength of the high-ductility material 21, and $S_1$ is strain as observed when the high-ductility material 21 produces the strength.

$$N_1=T/T_1 \quad 1)$$

The number of turns $N_2$ required for bringing a circumferential deformation to the allowable strain $X_0$ or less is calculated by $$N_2=(TS_1)/(T_1X_0) \quad 2)$$

Notably, it is assumed that the sheetlike high-ductility material 21 exhibits a proportional relation between strain and tension until the high-ductility material 21 produces the material strength. Synthetic fiber materials substantially exhibit a proportional relation. When the high-ductility material 21 is to be formed through application of a rubber material or an adhesive material by, for example, spraying, the above-mentioned calculation may be carried out on the basis of the individual tension-strain relation of such a material.

Specifically, when the relation of tension y and strain x of a certain material is expressed by a numerical function y=f(x) or graphically represented, the tension y per layer in the case of $N_2$ turns is expressed by $$y=T/N_2 \quad 3)$$

Since the allowable strain is $X_0$, the required number of turns $N_2$ can be obtained from the relation $T/N_2=f(X_0)$; i.e., $N_2$ is obtained as follows.

$$N_2=T/f(X_0) \quad 4)$$

Notably, the optimum number of turns N is $N_1$ or $N_2$, whichever greater, as obtained above.

Figure 8:
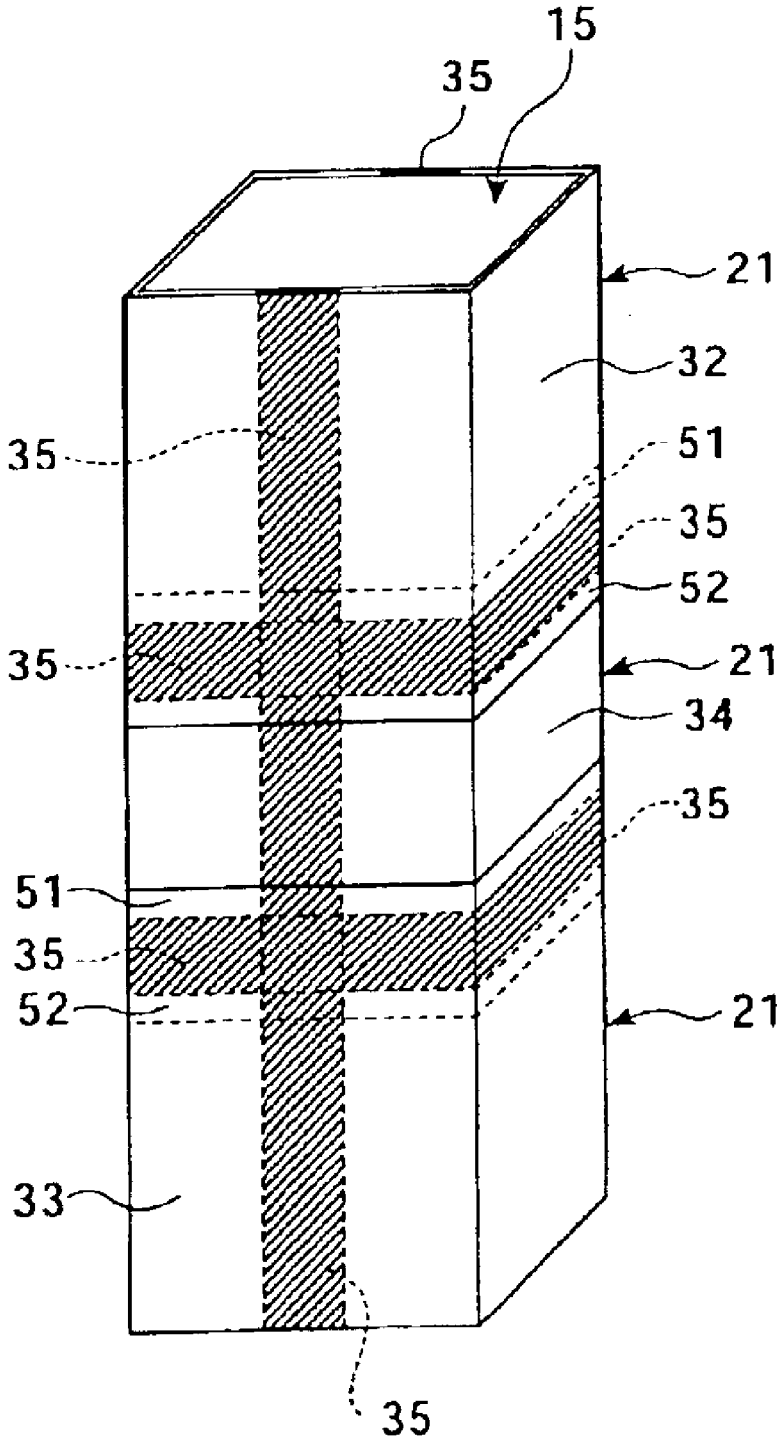
FIG. 8 is a general perspective view showing a state in which the example shown in FIGS. 7(*a*) and 7(*b*) is applied to each of three sections of a member.

FIG. 8 shows an example in which a roll of sheetlike high-ductility material 21 shown in FIG. 6 is applied to the column 15 whose internal height is greater than the width of the high-ductility material 21. The high-ductility materials 21 are rolled on the member 15 while being bonded to the member 15 by means of the adhesive 35 extending zonally along the length direction of the member 15, in a manner similar to that shown in FIGS. 7(*a*) and 7(*b*).

Specifically, first, the high-ductility material 21 is rolled on a central portion 34 of the member 15 in a manner similar to that shown in FIGS. 7(*a*) and 7(*b*). Another high-ductility material 21 is rolled on an upper end portion 32 of the member 15 while a lower edge portion 52 is bonded to an upper edge portion 51 of the high-ductility material 21 located at the central portion 34 by means of the adhesive 35. Still another high-ductility material 21 is rolled on a lower end portion 33 of the member 15 while an upper edge portion 51 is bonded to a lower edge portion 52 of the high-ductility material 21 located at the central portion 34 by means of the adhesive 35.

Thus, tension is transmitted among the three high-ductility materials 21 rolled on the respective portions of the member 15. The width of a bond surface is determined such that the adhesive strength of a bonded portion becomes not less than a required circumferential tension T. In this case, in place of bonding by means of the adhesive 35, any other appropriate connection means, such as sewing or fusion, can be employed. In this case, a required number of turns N for the high-ductility material 21 is determined in a manner similar to that for the example shown in FIGS. 7(*a*) and 7(*b*).

In consideration of installation conditions and work restrictions in relation to the member 15 to be covered, the high-ductility material 21 can be disposed in such a manner as to surround the member 15 or to be spirally wound on the member 15. Alternatively, the high-ductility material 21 can be disposed through application of a rubber viscous-material, such as silicone rubber, or a resin viscous-material, such as vinyl chloride, to the member 15 by appropriate application means, such as spraying, (the rubber and resin viscous-materials include those which contain short fibers of various materials). In this case, if the high-ductility material 21 is configurationally able to surround the member 15 or to be spirally wound on the member 15, an adhesive layer may be formed beforehand on at least one side of the high-ductility material 21, to thereby facilitate surrounding or winding work which involves bonding work. If necessary, an adhesive layer can be formed on the both sides of the high-ductility material 21 beforehand. In the case where the high-ductility material 21 is a covering material formed through application of a rubber or resin viscous-material to the member 15, the rubber or resin viscous-material can be applied manually but is preferably applied through spraying by use of an appropriate spraying device in consideration of work efficiency. When the member 15 is partially damaged or when a partial rupture of the member 15 due to stress concentration is expected, the high-ductility material 21 can be partially disposed on a region of the member 15 including the damaged portion or the portion to be potentially ruptured. In this case, a fibrous high-ductility material 21 having an adhesive layer or a high-ductility material 21 formed through application of a rubber or resin adhesive-material to the member 15 is preferably used.

Figure 23A:
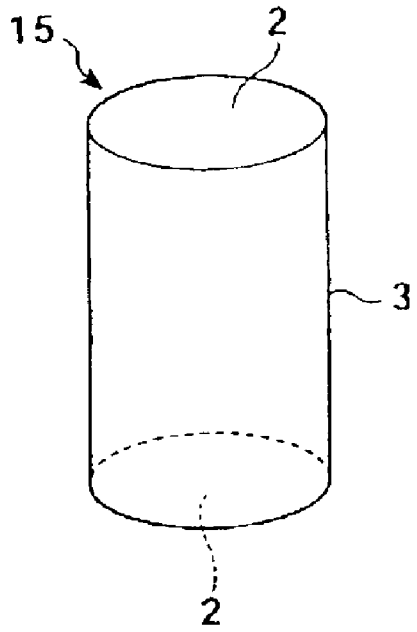
FIG. 23 is a series of views showing the phenomenon that an increase in apparent volume accompanies rupture of a member, wherein (a) shows a state before rupture; and (b) shows a state after rupture.
Figure 23B:
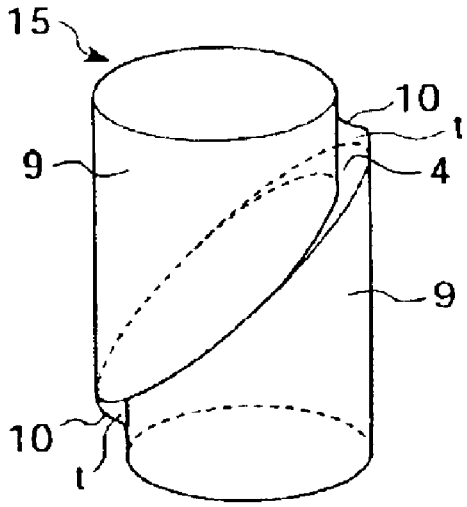
Figure 24A:
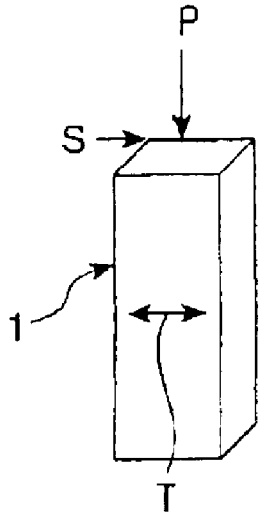
FIG. 24 is a series of explanatory views showing deformation behavior of a column, which serves as a member (a structural member), corresponding to that shown in FIG. 17, wherein (a) shows a normal state; (b) shows a state after start of deformation; and (c) shows a state of rupture.
Figure 24B:
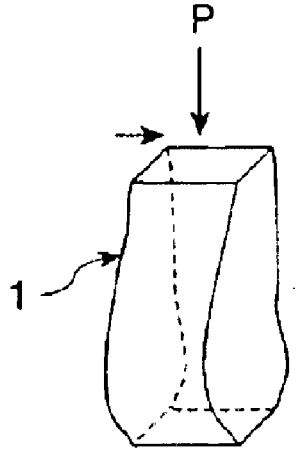
Figure 24C:
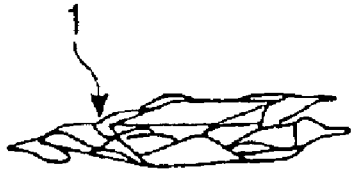

In order to control rupture of the member 15 through confining expansion of apparent volume accompanying the rupture, the high-ductility material 21 must enable the ruptured member 15 to maintain the formation of the enveloping surface 10 even after the member 15 has been ruptured. As seen from FIG. 23(*b*), this feature is enabled through formation of the cavity t between the enveloping surface 10 and the rupture pieces 9.

When the high-ductility material 21 is disposed on the outer circumferential surface of the member 15 by the method shown in FIG. 1, 2, or 3 without involvement of mutual bonding, a cavity (a weak layer) is formed therebetween, so that the enveloping surface is smoothly formed.

It must be remembered that, in addition to the methods and configurations exemplified in FIGS. 4 to 8, the method of forming the high-ductility material 21 by use of application means, such as spraying, involves the following problem. When the high-ductility material 21 is directly bonded to the member 15 without interposition of a cavity therebetween, even after the member 15 is ruptured, the adhesive layer maintains complete bond of the high-ductility material 21 to the outer circumferential surfaces of the rupture pieces 9 shown in FIG. 23(*b*). As a result, due to the generation of an acute angle or the concentration of stress, the rupture piece 9 is highly likely to cause rupture of the high-ductility material 21.

Conceivable measures against the above problem include the use of an adhesive which imparts, to the adhesive layer, an adhesive strength sufficiently lower than the strength of the high-ductility material 21 and the use of an adhesive which imparts, to the adhesive layer, an elastic modulus sufficiently lower than that of the high-ductility material 21, to thereby interpose a weak layer between the member 15 and the high-ductility material 21.

Rupture of the member 15 involves expansion of apparent volume, thereby causing an increase in a compressive force between the member 15 and the high-ductility material 21. Thus, even though the member 15 and the high-ductility material 21 are not bonded together, after the member 15 is ruptured, the ruptured member 15 and the high-ductility material 21 do not slide from each other by virtue of a pressure bearing action. Accordingly, bonding between the member 15 and the high-ductility material 21 is performed merely to prevent the high-ductility material 21 from coming off the member 15 during the period between the disposition of the member 15 and rupture of the member 15. Therefore, an adhesive strength to be induced through bonding may be such a degree as to be able to support the weight of the high-ductility material 21 on the outer circumferential surface of the member 15; i.e., so-called tentative bonding will suffice.

Figure 9A:
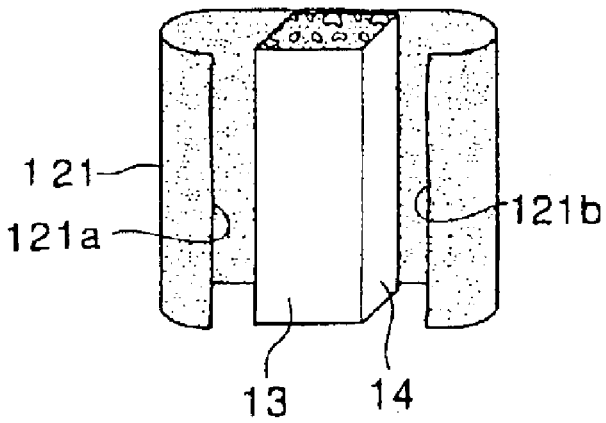
FIG. 9 is a series of schematic perspective views showing still another example of the present invention, wherein (a) shows a configurational relationship between an existing column and a high-ductility covering material; and (b) shows a state as observed after the high-ductility covering material is rolled on the column.
Figure 9B:
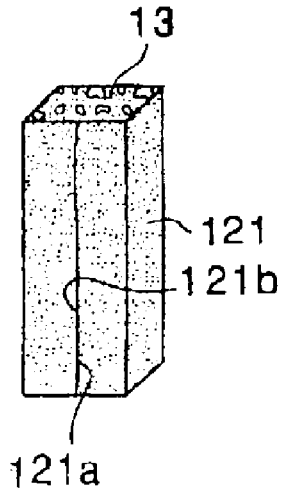

FIGS. 9(*a*) and 9(*b*) are schematic perspective views showing an example of the third invention, wherein (a) shows a configurational relationship between the existing column 13 formed of reinforced concrete or the like and adapted to support the floor 12 and the like of the structure (building) 11 schematically shown in FIG. 12(*a*) and a high-ductility covering material 121 formed of a raw material having an elastic modulus lower than that of a tie hoop; and (b) shows a state as observed after the high-ductility covering material 121 is rolled on the outer circumferential surface 14 of the column 13.

The high-ductility covering material 121 formed of a sheet material 122—which is made of a synthetic fiber material (e.g., TORAYSHEET, the trade name of a product of Toray Industries, Inc.) or a rubber material (e.g., GEOLINER, the trade name of a product of Bridgestone Corp.) having high ductility and strength capable of bearing a load—is preferably used. The high-ductility covering material 121 must maintain such a state as to completely surround the outer circumferential surface 14 of the column 13. Accordingly, after the high-ductility covering material 121 is rolled on the column 13, butt end portions 121*a* and 121*b* must be united together against separation from each other upon reception of load and bonded to the outer circumferential surface 14 of the column 13 directly or via interposition by use of adhesive or the like. Specifically, in the case of the sheet material 122 being a synthetic fiber material, the butt end portions 121*a* and 121*b* are sewn together by use of a patch applied thereto from behind. In the case of the sheet material 122 being a rubber material, the butt end portions 121*a* and 121*b* are bonded or heat-sealed together by use of a rubber patch applied thereto from behind. Preferably, the high-ductility covering material 121 is rolled on the column 13 over the overall length of the column 13. However, the high-ductility covering material 121 may be fixedly rolled on the entire column 13 except an upper portion thereof as needed. A circumferentially and vertically homogeneous material is used as the high-ductility covering material 121. Particularly, a fiber material or a rubber material whose ductility is high and whose initial elastic modulus is lower than that of iron and concrete is preferably used.

In order to prevent the high-ductility covering material 121 rolled on the column 13 from slipping along the outer circumferential surface 14 of the column 13, it is desirable that the high-ductility covering material 121 be reliably fixed to the column 13 by use of adhesive or appropriate fixture means, such as nails or screws.

Figure 10A:
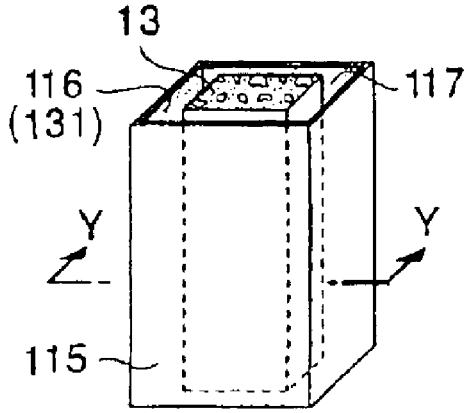
FIG. 10 is an explanatory view showing a further example of the present invention, wherein (a) is a schematic perspective view; and (b) is a cross-sectional view taken along line Y—Y of (a)
Figure 10B:
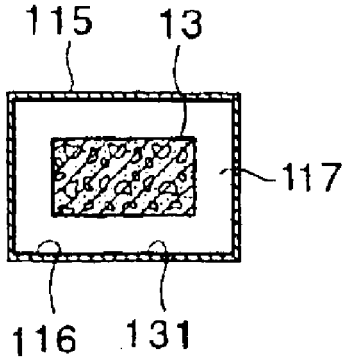

FIGS. 10(*a*) and 10(*b*) are a series of explanatory views showing an example of a fourth invention, wherein (a) is a schematic perspective view; and (b) is a cross-sectional view taken along line Y—Y of (a).

As shown in FIGS. 10(*a*) and 10(*b*), a facing surrounding wall material 115 patterned with marble patterns is disposed in such a manner as to surround the column 13 supporting the floor 12 and the like of the structure (building) 11 shown in FIG. 12(*a*) while a cavity 117 is interposed therebetween, to thereby conceal the column 13. Furthermore, a high-ductility covering material 131 is disposed on an inner circumferential surface 116 of the facing surrounding wall material 115 in such a manner as to surround the column 13. The high-ductility covering material 131 is made of a raw material having an elastic modulus lower than that of a tie hoop; for example, a synthetic fiber material (e.g., TORAYSHEET, the trade name of a product of Toray Industries, Inc.) or a rubber material (e.g., GEOLINER, the trade name of a product of Bridgestone Corp.) which is circumferentially and vertically homogeneous and whose initial elastic modulus is not particularly low.

Figure 11:
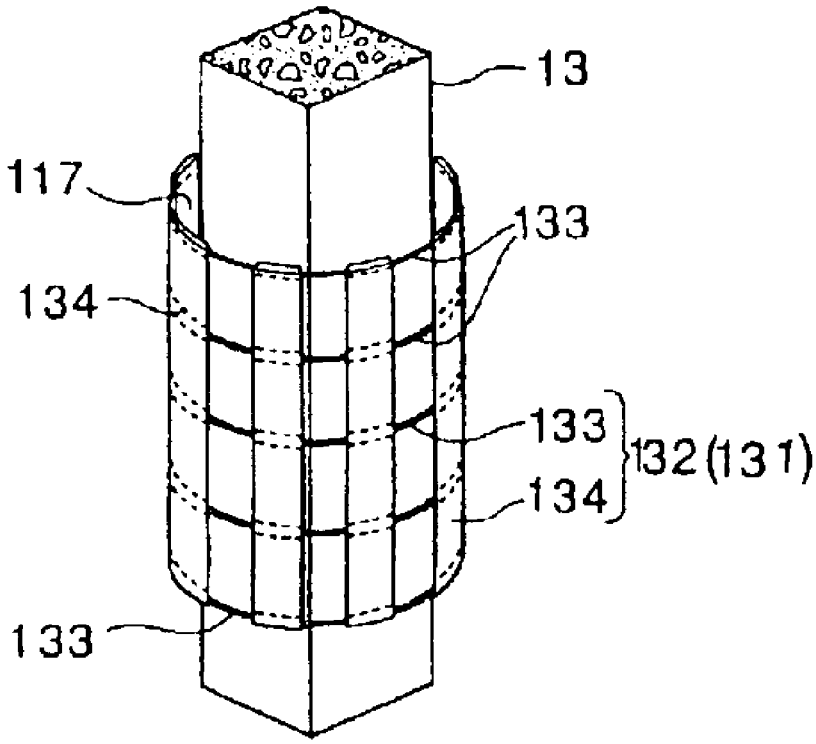
FIG. 11 is a perspective view of a main portion of a bellows-like reinforcement which is a modified embodiment of the high-ductility covering material shown in FIG. 10.

FIG. 11 shows another example of the high-ductility covering material 131 used in the present invention. The high-ductility covering material 131 includes a plurality of surrounding cores 133—each of which is formed of a reinforcing bar or annular elastic material and has an appropriate outside diameter—disposed around the column 13 with the cavity 117 interposed therebetween in such a manner as to be arranged at predetermined intervals along the vertical direction, and a sheet material 134 made of an appropriate synthetic fiber material (e.g., TORAYSHEET, the trade name of a product of Toray Industries, Inc.) or a rubber material (e.g., GEOLINER, the trade name of a product of Bridgestone Corp.) and connecting the adjacent surrounding cores 133 along the vertical direction, to thereby assume the form of an integral bellows-like reinforcement 132.

In this case, the number of the vertically arranged surrounding cores 133 is determined on the basis of the length of the column 13. The sheet material 134 can be connected to the surrounding cores 133 in such a manner as to surround the surrounding cores 133 along the entire circumference. Alternatively, as shown in FIG. 11, vertically extending strips of sheet material 134 can be connected to the surrounding cores 133 while being circumferentially arranged. Notably, the third invention can also use the high-ductility covering material 131 in place of the high-ductility covering material 121.

Next, the actions and effects of the present invention will be described.

Figure 15:
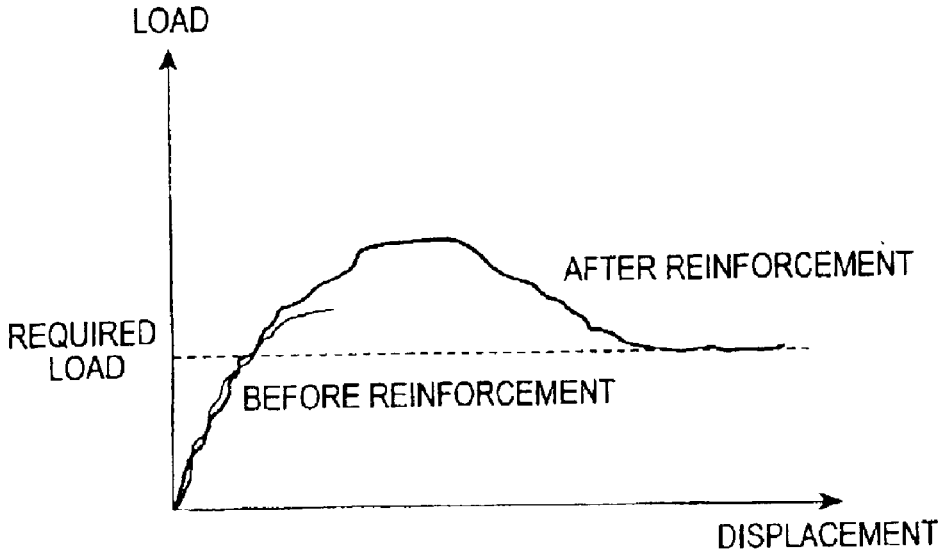
FIG. 15 is a graph showing deformation behavior ranging from deformation to rupture in the case where a member (a structural member) to which the present invention is applied is a column.
Figure 17:
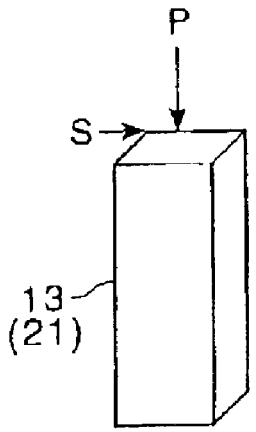
FIG. 17 is a series of explanatory views showing deformation behavior in the case where a member (a structural member) to which the present invention is applied is a column, wherein (a) shows a normal state; (b) shows a state after start of deformation; and (c) shows a state of rupture.
Figure 17:
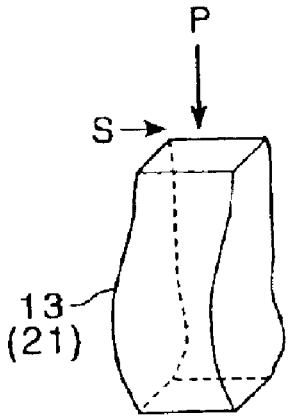
Figure 17:
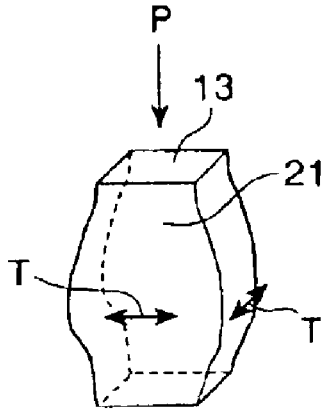

According to FIG. 15 showing deformation behavior as observed before and after reinforcement according to the present invention shown in FIG. 1 is carried out on the existing member 15; i.e., the column 12 serving as a structural member, which supports the structure (building) 11 as shown in FIG. 12(*a*), even at a load in excess of toughness limit, the reinforcing high-ductility material 21 can impart an upper-load support function capable of supporting a required load. Accordingly, as shown in FIG. 12(*b*), even after the structure (building) 11 is ruptured as a result of rupture of the columns 13 illustrated sequentially in FIGS. 17(*a*) to 17(*c*), the space 19 can be maintained between the floors 12. Thus, at greatly reduced material and work costs, the present invention can yield a highly safe fail-safe effect through implementation of the capability of maintaining a sufficiently large space 19 against human death from crush, irrespective of an external force imposed on the structural member 15.

Such capability of maintaining a certain space 19 can be implemented through control of the phenomenon that concrete, gravel, soil, brick or the like—which is widely used as an element for partially constituting the member 15, such as a structural member, of the structure 11 and which serves as an element for bearing part of a compressive force—exhibits expansion of apparent volume when undergoing deformation upon reception of compressive force or shearing force. Such phenomenon emerges significantly when a portion or the entirety of the member 15, such as a structural member, is ruptured and deformed greatly. The potential expansion of apparent volume of the member 15, such as a structural member, can be restrained by means of the high-ductility covering material 21. As a result, even after a material which partially constitutes the member 15, such as a structural member, is ruptured, the high-ductility covering material 21 enables the member 15 to bear an external force, thereby effectively preventing the occurrence of a great deformation and resulting collapse of the structure 11.

Figure 14A:
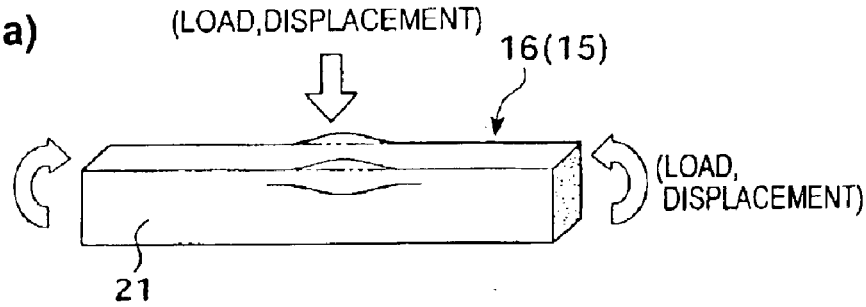
FIG. 14 is a series of explanatory views showing a state of a member (a structural member) to which the present invention is applied, wherein (a) shows a state of a beam serving as the member after the beam is deformed upon reception of a load; (b) shows a state of a floor serving as the member after the floor is deformed upon reception of a load; and (c) shows a state of a wall serving as the member after the wall is deformed upon reception of a load.
Figure 14B:
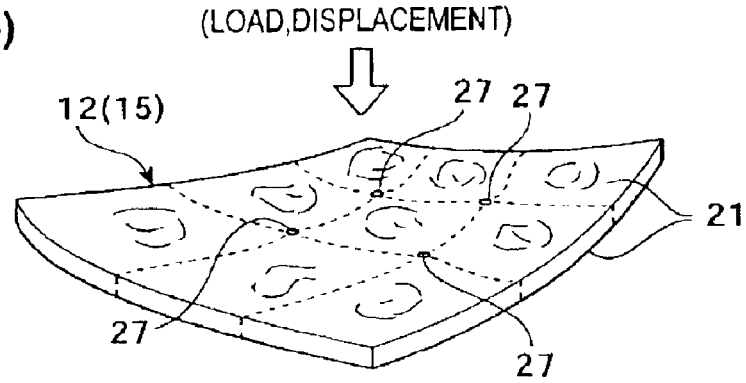
Figure 14C:
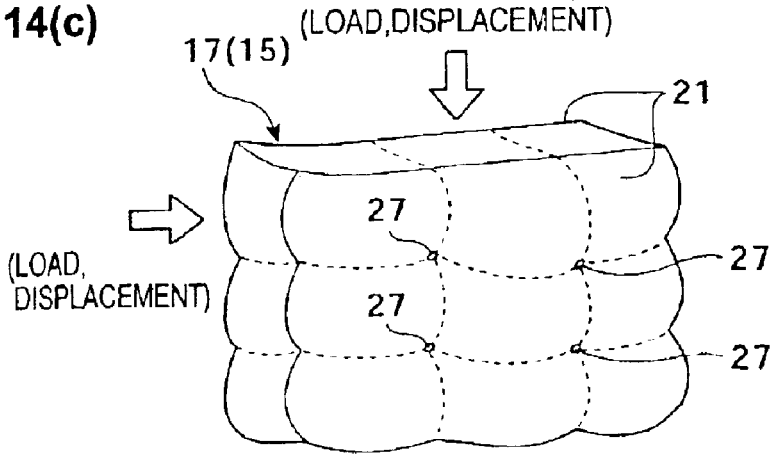
Figure 25:
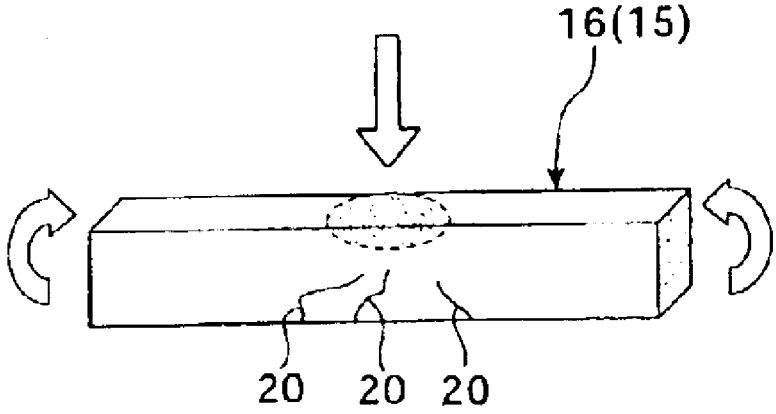
FIG. 25 is an explanatory view showing a state of a beam serving as a member (a structural member) to which the present invention is not applied, as observed after the beam is deformed.

Such an action will be described with reference to FIG. 14(*a*) showing an example of application of the present invention to the beam (girder) 16, which is one of the members (structural members) 15 shown in FIG. 12(*a*). When an external force induced by earthquake or the like causes compression rupture of a portion of the beam (girder) 16 subjected to compression, in contrast to the conventional reinforcement case shown in FIG. 25, the high-ductility material 21 can participate in bearing the external force while the portion is swollen like a lump. Thus, the beam (girder) 16 can maintain the capability of bearing a bending moment. FIG. 14(*b*) shows an example of application of the present invention to the floor 12, which is one of the members (structural members) 15 shown in FIG. 12(*a*). Similarly, FIG. 14(*c*) shows an example of application of the present invention to the wall 17. As shown in FIGS. 14(*b*) and 14(*c*), since the reinforcement members 27 connect the high-ductility materials 21, when the floor 12 (the wall 17) suffers compression rupture caused by an external force induced by earthquake or the like, the high-ductility materials 21 can bear the external force while the floor 12 (the wall 17) has swellings as does a floor cushion or a gym mat. In the case where the member (structural member) 15 is the floor 12, since the mechanism of the beam 16 is used, the reinforcement members 27 are disposed at four corners of a square measuring approx. 1 m×1 m. In the case where the member (structural member) 15 is the wall 17, since the mechanism of the column 13 is used, the reinforcement members 27 are disposed in a pattern similar to that for the floor 12.

The high-ductility material 21 is disposed on the outer circumferential surface 14 of the member 15, such as a structural member, in such a manner as to surround the member 15 or to be spirally wound or rolled on the member 15. Thus, when a portion of the member 15 or the entire member 15 is ruptured upon reception of bending, shearing, or compression with a resultant deformation accompanied by expansion of volume, the elasticity of the high-ductility material 21 causes imposition of a circumferential compressive force on the member 15. The circumferential compressive force has the effect of restraining expansion of apparent volume of the member 15, thereby functioning against the deformation of the member 15 caused by bending, shearing, or compression. As a result, even after the member 15 is ruptured, the ruptured member 15 can resist bending, shearing, or compression imposed thereon. Furthermore, the disposed high-ductility material 21 can be easily removed.

When the high-ductility covering material 121 is to be used as in the fourth invention, the high-ductility covering material 121 is rolled, in a fixedly surrounding condition as shown in FIG. 13(*a*), on the outer circumferential surface 14 of an existing column 13 supporting the structure (building) 11 as shown in FIG. 12(*a*). As a result, as shown in FIG. 13(*b*), the high-ductility covering material 21 encloses the deformed column 13, thereby enabling the column 13 to bear a load.

In this case as well, even at a load in excess of toughness limit, the reinforcing high-ductility material 121 can impart an upper-load support function capable of supporting a required load. Accordingly, as shown in FIG. 12(*b*), even after the structure (building) 11 is ruptured as a result of rupture of the columns 13 illustrated sequentially in FIGS. 17(*a*) to 17(*c*), the space 19 can be maintained between the floors 12.

When, as in the case of the fifth invention and as shown in FIGS. 10(*a*) and 10(*b*), the facing surrounding wall material 115 is disposed in such a manner as to surround an existing column 13 supporting the structure 11 shown in FIG. 12(*a*), interposing a cavity 117 between the existing column 13 and the facing surrounding wall material 115, the disposition of the high-ductility covering material 131 on the inner circumferential surface 116 of the facing surrounding wall material 115 yields the following effect: the high-ductility covering material 131 encloses the deformed column 13, thereby enabling the deformed column 13 to bear a load.

In this case, preferably, the high-ductility covering material 131 includes a plurality of surrounding cores 133 disposed around the column 13 with the cavity 117 interposed therebetween in such a manner as to be arranged at predetermined intervals along the vertical direction, and the sheet material 134 made of a synthetic fiber material or a rubber material and connecting the adjacent surrounding cores 133 along the vertical direction, to thereby assume the form of the integral bellows-like reinforcement 132. Notably, the third invention can also use the high-ductility covering material 131 in place of the high-ductility covering material 121.

The disposition of the high-ductility covering material 131 within the cavity 117 interposed between the column 13 and the facing surrounding wall material 115 yields the following effect: for the deformation of the column 13 made of reinforced concrete before the toughness limit of the column 13 is reached, no load is imposed on the high-ductility covering material 131; and the subsequent deformation is coped with by means of ductility of the high-ductility covering material 131; i.e., the high-ductility covering material 131 encloses the deformed column 13, thereby enabling the deformed column 13 to bear a load. Thus, as in the case of the third invention, as shown in FIG. 12(*b*), even after the structure (building) 11 is ruptured as a result of rupture of the columns 13 illustrated sequentially in FIGS. 17(*a*) to 17(*c*), the space 19 can be maintained between the floors 12.

Figure 16:
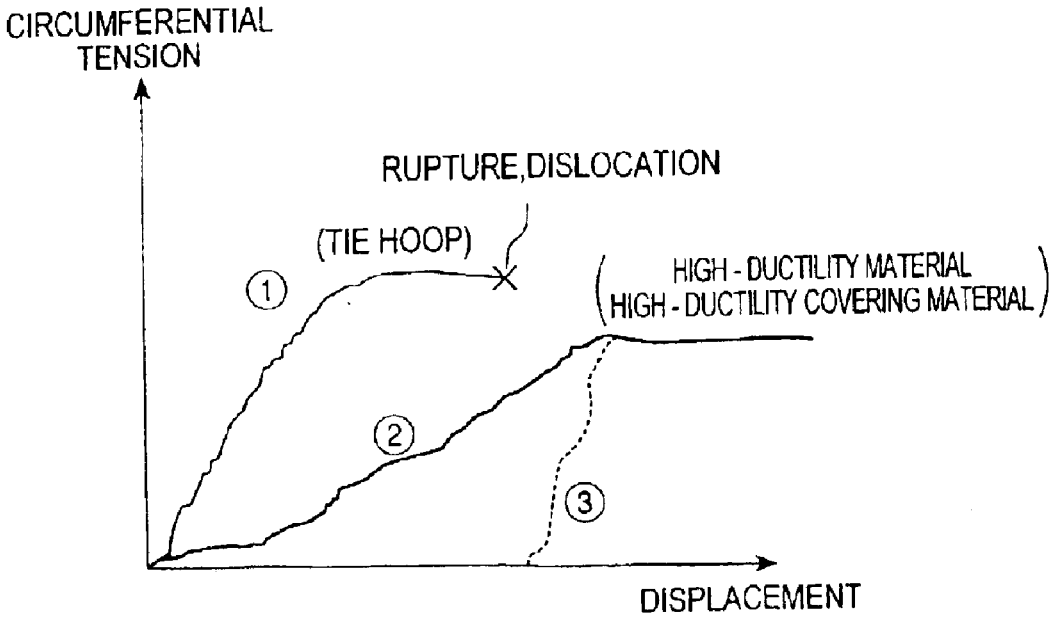
FIG. 16 is a graph showing behavior ranging from deformation to rupture in the case where a member (a structural member) is a column, while a conventional reinforcement and a reinforcement of the present invention are compared.

FIG. 16 is a graph showing deformation behavior in relation to a conventional reinforcement and the present invention. As shown in FIG. 16, in the case of the conventional reinforcement, when the circumferential tension increases beyond a toughness limit, a tie hoop(s) is ruptured or dislocated, resulting in collapse of a member (see graph ① in FIG. 16). By contrast, in the case where the high-ductility material 21 or the high-ductility covering material 121 is rolled on the column 13, which is one of the members (structural members) 15, according to the present invention, upon start of the displacement of the column 13, a load is imposed on the high-ductility material 21 or the high-ductility covering material 121. However, even when a tie hoop(s) is ruptured or dislocated, collapse of the column 13 can be avoided, so that the column 13 can bear a load (see graph ② in FIG. 16). In the case where the high-ductility covering material 131 is disposed in the cavity 117 interposed between the column 13 and the facing surrounding wall material 115, no load is imposed on the high-ductility covering material 131 before the toughness limit of the column 13 is exceeded; in other words, a load is imposed on the high-ductility covering material 131 after the toughness limit is exceeded with a resultant rupture or dislocation of a tie hoop(s). However, collapse of the column 13 can be avoided, so that the column 13 can bear a load (see graph ③ in FIG. 16).

Next, the tensile strength that a high-ductility material or a high-ductility covering material used in the present invention must assume, together with calculation examples, will be specifically described. Notably, when a member (e.g., a column), such as a structural member, is ruptured into concrete lumps and deformed reinforcing bars, the dynamic behavior of the ruptured member in the form of lumps and deformed reinforcing bars becomes complicated. Since the whole of concrete lumps and deformed reinforcing bars can generally be regarded as granular materials having internal friction, the high-ductility material must has a dynamic function for serving as a net or enclosure for retaining a ruptured member (e.g., a ruptured column) to thereby become resistant to an axial force. Also, the high-ductility material must not be broken when a pressure induced by the axial force within the enclosure is imposed thereon.

Figure 18:
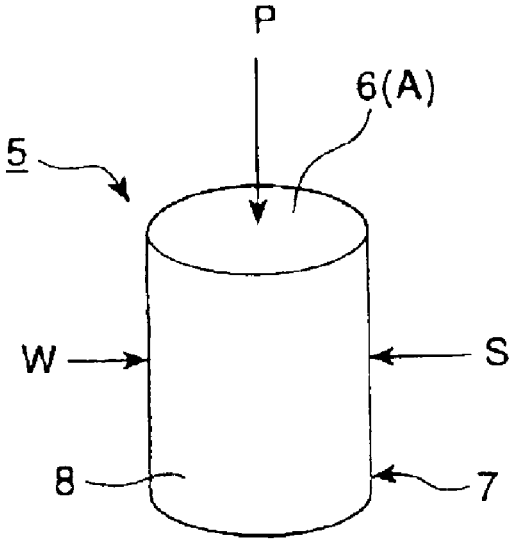
FIG. 18 is a schematic explanatory view showing a three-axis test unit used widely in the soil mechanics area.

FIG. 18 is a schematic explanatory view showing a three-axis test unit used widely in the soil mechanics area for testing the relationship between axial force and confining pressure of granular materials, such as soil, gravel or the like. Granular materials are filled into a container 5 composed of a top cover 6 and a closed-bottomed cylindrical surface 7. While a hydraulic pressure W is imposed on the granular materials from a side surface 8 through a thin film, an axial force P is imposed on the granular materials. The relation between the vertical axial force P and a confining pressure S is known to be expressed by the following expression, where $\phi$ is the internal friction of the granular materials, and A is the area of the top cover 6 (the cross-sectional area of the container 5).

$$P/A=\{(1+\sin\phi)\cdot S\}/(1-\sin\phi) \quad 5)$$

The relation between the confining pressure S and a tension $T_s$ per unit width is expressed by the following expression, where D is the horizontal diameter of the container 5.

$$T_s=(DS)/2 \quad 6)$$

In order to yield an expected effect, the high-ductility material (high-ductility covering material) according to the present invention assumes strength as calculated below. Assuming that a ruptured column of reinforced concrete corresponds to granular materials mentioned above and on the basis of the relations expressed above by Expressions 5) and 6), a strength T required for avoiding rupture of the high-ductility material (high-ductility covering material) upon reception of an axial force P required for avoiding collapse of a structure is expressed by the following expression, where B is the cross-sectional area of a top portion of the column.

$$T=\{(1-\sin\phi)D\cdot P\}/\{2(1+\sin\phi)B\} \quad 7)$$

The axial force P required for avoiding collapse of a structure can be calculated by $$P=fW/N_p \quad 8)$$

where W is the total weight of a portion of the structure above the floor concerned; $N_p$ is the total number of columns of the floor concerned; and f is the safety factor in consideration of variations in load to bear per column. These parameters can be calculated on the basis of a specific plan of the structure.

As described above, the required tensile strength of a high-ductility material can be calculated. However, in view of prevention of occurrence of an excessive deformation of a structure through suppression of a circumferential strain of the high-ductility material to an allowable value or less, the required number of turns or the required thickness of the high-ductility material can be determined from Expression 2) or 4) by use of the required strength T as calculated by Expression 7) and the allowable strain $X_0$ of the high-ductility material.

Next will be described an example of calculation in relation to a specific structure by use of the calculation expressions described above. Among reinforced concrete structures which are generally seen in Japan, buildings which were constructed in or before 1980 usually have a weight of approx. 11.8 kN/m$^2$ per floor. Among these buildings, a medium-sized four-story building having a floor area of 200 m$^2$ per story and 12 columns each having a head-portion cross-sectional area of 3500 cm$^2$ is taken as an example and subjected to the calculation as follows.

Total weight to bear W=200×11.8×4=9440 kN

Axial force per column P=2×9440/12=1573 kN

It is to be noted that calculation by Expression 8) employed f=2.

Required strength of high-ductility material (high-ductility covering material) T=327 N/mm It is to be noted that calculation by Expression 7) employed $\phi$=40 degrees, D=67 cm, B=3500 cm$^2$, and P=1573 kN, where D is a diameter of a cross-sectional area B.

An example of a textile sheet material having the above-calculated required strength is TORAYSHEET (the trade name of a product of Toray Industries, Inc.) Model NSB2000 (thickness 4.7 mm). Since TORAYSHEET Model 800T (thickness 1.26 mm) has a strength of 283 N/mm, TORAYSHEET Model 800T arranged in two layers can endure a tensile strength of 566 N/mm, thus indicating sufficient applicability to reinforcement of the above example structure. An example of a rubber sheet material is GEOLINER (the trade name of a synthetic-polymer/vulcanized-rubber product of Bridgestone Corp.). GEOLINER exhibits a strength test result of 13.2 N/mm$^2$. GEOLINER having a thickness of approx. 2.5 cm exhibits the required strength.

The nominal strength of TORAYSHEET is reached at a strain of 15%. Before the nominal strength is reached, strain and tension are in a proportional relation. Thus, when TORAYSHEET Model 800T is used in two layers, a strain at which the required strength is reached is calculated as 327/566×15%=8.7%. When the circumferential strain is to be suppressed to 5% or less, TORAYSHEET Model 800 may be used in four layers. In this case, a strain that occurs at the required strength can be rendered 327/(283×4)×15%=4.3%. In the case of a high-ductility material formed of a rubber material, tension and strain are in a nonlinear relation. However, as in the case of the above calculation example, the thickness of the high-ductility material required for suppressing the strain of the high-ductility material to an allowable strain or less can be calculated through utilization of the gist of Expressions 3) and 4) described previously.

Particularly, the present invention can cope with deformation involving a strain of not less than 2% (the rupture strain of iron). Particularly, a high-ductility material (a high-ductility covering material) formed of a synthetic fiber sheet material can cope with deformation involving a strain of up to 15%; and a high-ductility material (a high-ductility covering material) formed of a rubber sheet material can cope with deformation involving a strain of 100% or greater (up to 690%, which is an upper limit in view of quality characteristics of material). Experiment has shown that, even when the above-mentioned sheet material used as reinforcement is ruptured, a peripheral sound portion of the sheet material causes propagation of a ruptured region to become sluggish; as a result, rupture can be controlled even under deformation involving an axial strain of 50% or greater.

Figure 19A:
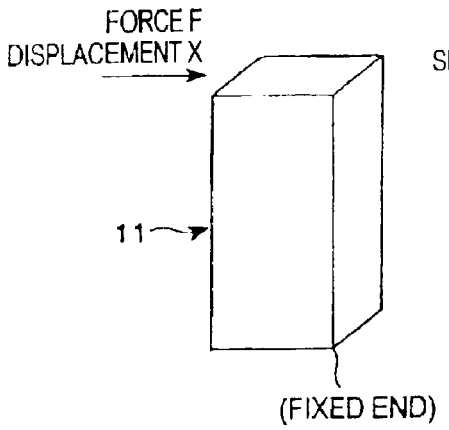
FIGS. 19(*a*) and 19(*b*) are explanatory views showing the relationship between force imposed on and displacement arising on a structure and columns, which serve as members (structural members) of the structure, upon occurrence of earthquake.
Figure 19B:
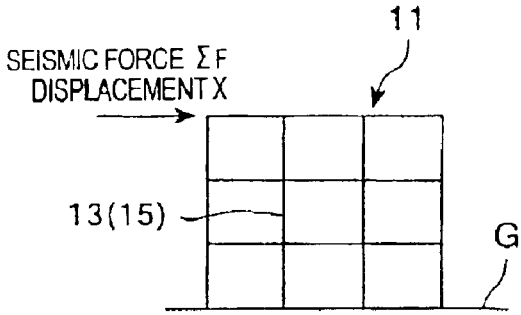
Figure 20A:
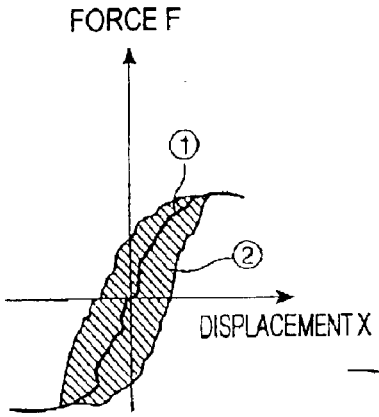
FIG. 20 is a series of graphs showing a state of absorbed energy per cycle in relation to a column serving as a member (a structural member), wherein (a) shows a state in the case of a conventional column; and (b) shows a state in the case of a column reinforced according to the present invention.
Figure 20B:
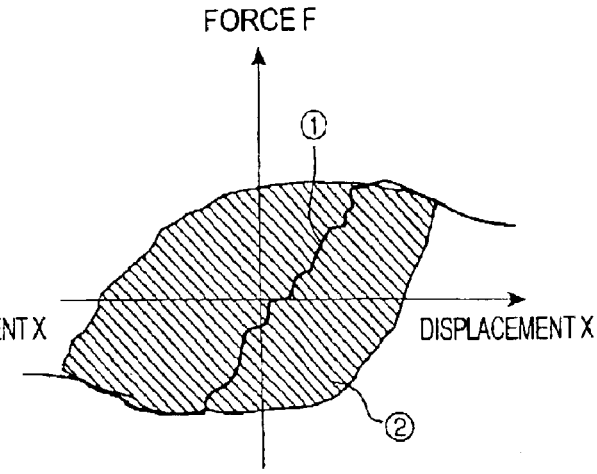
Figure 21:
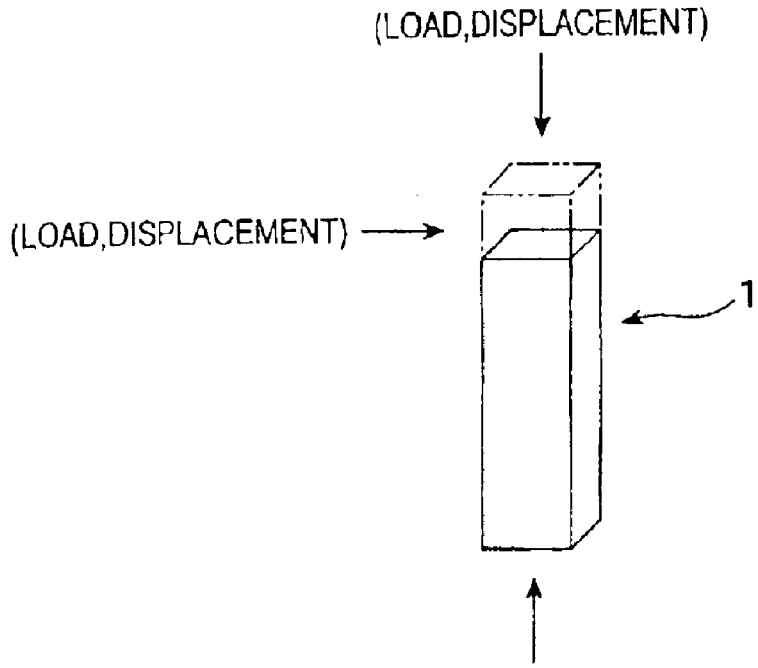
FIG. 21 is an explanatory view showing directions along which a load is imposed on a column serving as a member (a structural member) and along which displacement arises on the column.
Figure 22:
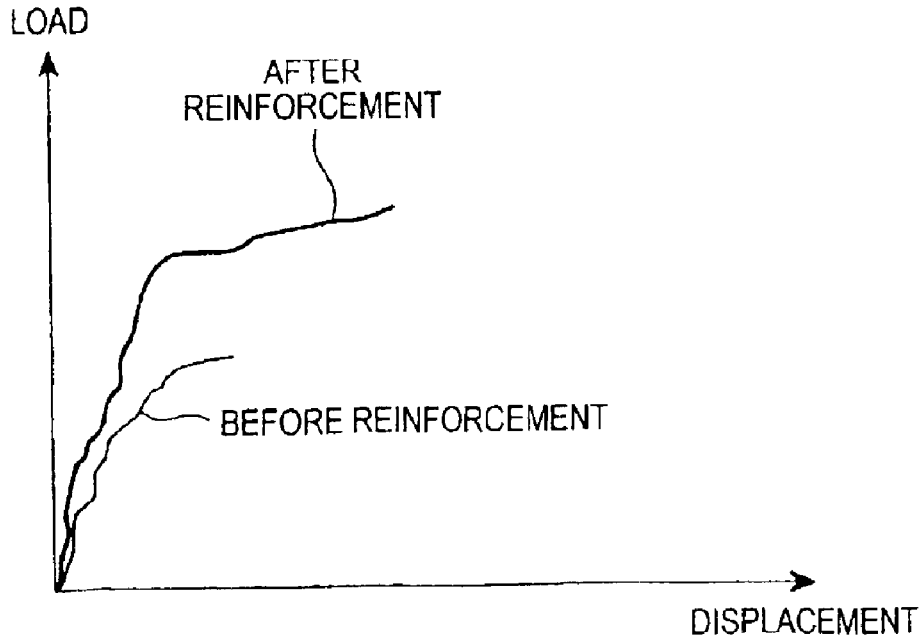
FIG. 22 is a graph showing deformation behavior before and after application of conventional reinforcement, in relation to a column serving as a member (a structural member) on which a load is imposed as shown in FIG. 21 and on which deformation arises as shown in FIG. 21.

As shown in FIGS. 19(*a*) and (*b*), upon occurrence of an earthquake, an inertia force is imposed on the structure 11, with a resultant occurrence of displacement. Accordingly, a force F is repeatedly imposed on the columns 13, which serve as members (structural members) 15, thereby causing occurrence of a displacement X while energy is being absorbed. FIG. 20(*a*) is a graph showing a state of absorbed energy per cycle as observed in the case of no reinforcement provided or reinforcement provided by a conventional method; and FIG. 20(*b*) is a graph showing a state of absorbed energy per cycle as observed in the case of reinforcement provided according to the present invention. In FIGS. 20(*a*) and 20(*b*), a solid line denoted by ① indicates monotone loading, and a region denoted by ② indicates repeated loading.

As seen from FIGS. 20(*a*) and 20(*b*), the member (e.g., the column 13) 15, such as a structural member, reinforced according to the present invention exhibits a large amount of absorbed energy to thereby endure large deformation. When kinetic energy which is stored in the structure 11 as a result of reception of seismic action is all absorbed through irreversible motion, such as friction arising within the structure 11 and between the structure 11 and peripheral ground G, vibration of the structure 11 stops. Because of a large amount of absorbed energy per cycle, the member (e.g., the column 13) 15 reinforced according to the present invention exhibits better vibration-damping effect; i.e., termination of vibration in a smaller number of cycles, or in a shorter period of time, as compared with the case of an unreinforced structure or a structure reinforced by a conventional method. Also, since control of rupture of a member suppresses the upper limit of load to be propagated to a peripheral region, large deformation/strain can be caused to arise under such loading conditions, thereby restricting the amount of input to a structure of an abrupt external force induced by earthquake or the like; i.e., thereby yielding a so-called seismic isolation effect.

Furthermore, the present invention can be applied to tentative reinforcement for a structure until the structure is rebuilt or undergoes required reinforcement work. Specifically, the present invention can be used effectively not only as measures against collapse of a building in the course of demolition of the building but also as emergency measures against increased danger in relation to potential earthquake under a state in which, in the course of reinforcement work by a conventional method continuing for a long period of time, a strength unbalance is present between structural portions which have already been reinforced and those which are to be reinforced. Also, the present invention allows reduction in the size and material strength of various component members, including structural members, of a structure, so that construction costs can be reduced as compared with the case of a conventional method.

Also, the present invention yields the following collapse prevention effect: after reinforcement of the present invention is used as a cloth form in the course of casting concrete, the clothe form is left unremoved.

As described above, in the case where a high-ductility material or a high-ductility covering material is fixedly attached to each of various members, including structural members, of a structure according to the present invention, upon start of the displacement of the column, a load is imposed on the high-ductility material or the high-ductility covering material. However, even when the structure collapses as a result of rupture or dislocation of a tie hoop(s), the load can be supported while a space is maintained between a ceiling and a floor or between floors, thereby yielding a lifesaving fail-safe effect upon occurrence of earthquake or the like.

Even when members, including structural members, of a structure are deformed greatly, the present invention enables the deformed members to maintain a function for supporting the weight of the structure, thereby enabling absorption of a greater amount of vibration energy as compared with the case of reinforcement by a conventional method or no reinforcement employed and thus yielding a vibration-damping effect for damping vibration of the structure induced by an earthquake motion. Furthermore, since control of rupture of a member suppresses the upper limit of load to be propagated to a peripheral region, large deformation/strain can be caused to arise under such loading conditions, thereby restricting the amount of input to a structure of an abrupt external force induced by earthquake or the like; i.e., thereby yielding a so-called seismic isolation effect.

The present invention can be used effectively not only as measures against collapse of a building in the course of demolition of the building but also as emergency measures against increased danger in relation to potential earthquake under a state in which, in the course of reinforcement work by a conventional method continuing for a long period of time, a strength unbalance is present between structural portions which have already been reinforced and those which are to be reinforced. That is, the present invention can be favorably applied to tentative reinforcement for a structure until the structure is rebuild or undergoes required reinforcement work.

The present invention enables performance of reinforcement work within a short period of time, thereby attaining low installation work cost. Also, the present invention allows reduction in the size and material strength of various members including structural members to thereby cut material costs greatly, so that construction costs for a structure itself can be reduced as compared with the case of a conventional method.

The present invention enables easy, prompt performance of reinforcement work without need of skilled workers and easy reinforcement for a partially damaged member. Through storage of high-ductility material or high-ductility covering material together with a bonding member, such as adhesive, emergency reinforcement can be promptly performed for a large number of structures upon occurrence of disaster, such as earthquake. Reinforcement work according to the present invention may be performed in parallel with emergency work for evaluation of the degree of collapse risk, whereby, even when an examiner(s) is involved in the collapse of a structure under examination due to aftershock or the like, the risk of his/her being killed or injured can be greatly decreased.

In the case where a high-ductility covering material is disposed in a cavity interposed between a column and a facing surrounding wall material, no load is imposed on the high-ductility covering material before the toughness limit of the column is exceeded; in other words, a load is imposed on the high-ductility covering material after the toughness limit is exceeded with a resultant rupture or dislocation of a tie hoop(s). However, even after a structure collapses, the load can be supported while a space is maintained between a ceiling and a floor or between floors, thereby yielding a lifesaving fail-safe effect.

When a cored roll of high-ductility material according to the present invention is used, a user can easily know the maximum number of overlap turns of the high-ductility material wound spirally on a member without use of equipment, such as a measuring tool. Thus, the material can be efficiently wound on a member. Such easy winding work means that a newly constructed member or an existing member can be reinforced promptly and accurately by use of a cored roll of high-ductility material and that cored rolls of high-ductility material can be stored for effective use upon occurrence of disaster. The number of turns of a high-ductility material to be wound on a member is determined according to a maximum load which the member must bear. However, the number of turns vary depending on a structure to which the high-ductility material is applied. Even in such a case, a cored roll of high-ductility material according to the present invention can cope with any number of turns ranging from a single turn to multiple turns, which the same high-ductility material is used. Thus, cored rolls of high-ductility material can be stored without consideration of application structures and can be applied to any structures upon occurrence of disaster. Particularly, in the case of a cored roll of high-ductility material on which a plurality of parting lines are drawn such that they can visually or tactilely be discriminated from one another, the parting lines can be easily discriminated from one another on a work site. In the case where the parting lines each assume the form of a protrusion, winding is performed while an edge portion of a layer of the high-ductility material is aligned with the protrusion of the underlying layer of the high-ductility material, thereby facilitating winding in a reliable condition and thus effectively contributing to enhancement of work efficiency.

Notably, when a high-ductility material is spirally wound or rolled on a member according to the present invention while facing layers of the high-ductility material are bonded at a zonal region extending along the length direction of the member, the following effect is yielded. Even when a certain layer of the high-ductility material is ruptured, the residual layers prevent immediate loss of tension.

INDUSTRIAL APPLICABILITY

As described above, the present invention can be applied to a structure or the like constructed of concrete, wood, soil, brick or the like.

What is claimed is:

1. A method for reinforcing a structure comprising:

disposing a high-ductility material on an outer circumferential surface of a member of the structure to restrain expansion of apparent volume accompanying rupture of the member, to thereby control rupture of the member;

winding the high-ductility material by a single turn at a winding start end of the member;

winding the high-ductility material spirally while a number of overlap turns is sequentially increased until a predetermined maximum number of overlap turns is reached;

winding the high-ductility material spirally while the maximum number of overlap turns is maintained along a predetermined length of member; and winding the high-ductility material spirally while the number of overlap turns is sequentially decreased such that the high-ductility material is wound by a single turn at a winding termination end of the member.

2. A configuration for reinforcing a structure comprising:

a high-ductility material configured to be disposed on an outer circumferential surface of a member of the structure of elastically restrain expansion of apparent volume accompanying rupture of the member, to thereby control rupture of the member, wherein the high-ductility material comprises a fiber origin or rubber origin tape-like sheet material and is configured to be wound spirally on an outer surface of the member in a fixed and overlapping condition, and wherein the high-ductility material is configured to be wound by a single turn at a winding start end of the member, spirally while a number of overlap turns is sequentially increased until a predetermined maximum number of overlap turns is reached, spirally while the maximum number of overlap turns is maintained along a predetermined length of the member and spirally while the number of overlap turns is sequentially decreased such that the high-ductility material is wound by a single turn at a winding termination end of the member.

3. A method for reinforcing a structure comprising;

fixedly attaching a high-ductility covering material formed of a raw material having an elastic modulus lower than that of a tie hoop to an outer circumferential surface of an existing column supporting the structure, to thereby cause the high-ductility covering material to bear a load imposed on the column after the column is deformed;

wherein the high-ductility covering material comprises a plurality of surrounding cores disposed around the column to be arranged at predetermined intervals along a vertical direction, and a fiber origin or rubber origin sheet material connecting the adjacent surrounding cores along the vertical direction, to thereby assume a form of an integral bellows-like reinforcement.

4. A method for reinforcing a structure comprising:

disposing a high-ductility covering material formed of a raw material having an elastic modulus lower than that of a tie hoop inside a facing surrounding wall material disposed around an existing column supporting the structure with a cavity interposed between the facing surrounding wall material and the column, to thereby cause the high-ductility covering material to bear a load imposed on the column after the column is deformed;

wherein the high-ductility covering material comprises a plurality of surrounding cores disposed around the column with the cavity interposed between the plurality of surrounding cores and the column to be arranged at predetermined intervals along a vertical direction, and a fiber origin or rubber origin sheet material connecting the adjacent surrounding cores along the vertical direction, to thereby assume a form of an integral bellows-like reinforcement.

5. A configuration for reinforcing a structure comprising:

high-ductility covering material formed of a raw material having an elastic modulus lower than that of a tie hoop configured to be fixedly attached to an outer circumferential surface of a member supporting the structure, wherein the high-ductility covering material comprises a plurality of surrounding cores configured to be disposed around the column to be arranged at predetermined intervals along a vertical direction, and a fiber origin or rubber origin sheet material connecting the adjacent surrounding cores along the vertical direction, to thereby assume a form of an integral bellow-like reinforcement.

6. A configuration for reinforcing a structure comprising:

a high-ductility covering material formed of a raw material having an elastic modulus lower than that of a tie hoop configured to be dispose inside a facing surrounding frame disposed around a member supporting the structure with a cavity interposed between the facing surrounding frame and the column, wherein the high-ductility covering material comprises a plurality of surrounding cores configured to be disposed around the column with the cavity interposed between the plurality of surrounding cores and the column to be arranged at predetermined intervals along a vertical direction, and a fiber origin or rubber origin sheet material connecting the adjacent surrounding cores along the vertical direction, to thereby assume a form of an integral bellows-like reinforcement.

7. A high-ductility covering material comprising:

a plurality of surrounding cores configured to be disposed around a member to be arranged at predetermined intervals along a vertical direction; and a fiber origin or rubber origin sheet material connecting the adjacent surrounding cores along the vertical direction, to thereby assume a form of an integral bellows-like reinforcement.

8. A high-ductility covering material comprising:

a plurality of surrounding cores configured to be disposed around a member with a cavity interposed between the plurality of surrounding cores and the member to be arranged at predetermined intervals along a vertical direction; and a fiber origin or rubber origin sheet material connecting the adjacent surrounding cores along the vertical direction, to thereby assume a form of an integral bellows-like reinforcement.

9. A method for reinforcing a structure comprising:

fixedly attaching a high-ductility material having an initial elastic modulus lower than an elastic modulus of concrete to an outer circumferential surface of a member of the structure to restrain expansion of apparent volume accompanying rupture of the member, to thereby control rupture of the member and support of a portion of the load of the structure after rupture of the member; and determining an amount of the material to attach based on a load of the member and an amount of a deformation in a peripheral direction allowed by the member.

* * * * *